United States Patent [19]

Rottinghaus

[11] Patent Number: 4,930,326

[45] **Date of Patent: * Jun. 5, 1990**

[54] MANUAL HOSE END CRIMPER

[76] Inventor: Robert B. Rottinghaus, 4121 S. Caufield Road, Jesup, Iowa 50648

[ * ] Notice: The portion of the term of this patent subsequent to Jul. 18, 2006 has been disclaimed.

[21] Appl. No.: 312,714

[22] Filed: Feb. 21, 1989

Related U.S. Application Data

[63] Continuation-in-part of Ser. No. 197,155, May 23, 1988, Pat. No. 4,848,121.

[51] Int. Cl.[5] ..... B21D 17/04

[52] U.S. Cl. ..... 72/35; 72/121; 72/126

[58] Field of Search ..... 72/118, 119, 120, 121, 72/126, 211; 30/94, 95, 102; 269/137

[56] References Cited

U.S. PATENT DOCUMENTS

| | | | |
|---|---|---|---|
| 1,638,219 | 8/1927 | Scott | 72/126 |
| 1,764,513 | 6/1930 | Kalfus . | |
| 2,645,141 | 7/1953 | Anthony et al. . | |
| 2,684,102 | 7/1954 | Clerke . | |
| 2,725,774 | 12/1955 | Tekse | 30/102 |
| 2,813,442 | 11/1957 | Wingate . | |
| 3,243,878 | 4/1966 | Bjalme et al. | 30/95 |
| 3,329,000 | 7/1967 | Schwab et al. . | |
| 3,517,539 | 6/1970 | Chirco . | |
| 4,050,286 | 9/1977 | Gasier et al. . | |
| 4,192,171 | 3/1980 | Hamilton . | |
| 4,276,765 | 7/1981 | Yoneda . | |
| 4,339,942 | 7/1982 | Svensson . | |
| 4,389,867 | 6/1983 | Whitlock . | |
| 4,655,064 | 4/1987 | Hoback . | |
| 4,848,121 | 7/1989 | Rottinghaus | 72/121 |

FOREIGN PATENT DOCUMENTS 846328 8/1960 United Kingdom .

OTHER PUBLICATIONS

Publication of Signal Hill Corporation, 5280 W. 56th Avenue, Arvada, Colorado 80002, entitled "'Hosecomatic' Do It Yourself Hose Crimper".

*Primary Examiner*—Lowell A. Larson
*Attorney, Agent, or Firm*—Emrich & Dithmar

[57] ABSTRACT

A manual crimping apparatus for attaching a ferrule to the end of a hose includes a pair of facing die carriers each having a pair of spaced carrier plates and a respective pair of roller dies coupled thereto and positioned therebetween. All of the carrier plates are identical in size and configuration. Moving the two die carriers toward one another positions the four roller dies about and in tight engagement with the outer periphery of a ferrule. With the rotational axes of each of the roller dies not aligned with the ferrule's longitudinal axis, rotational displacement of the crimper about the ferrule causes the roller dies to travel about the ferrule in a spiral path permitting virtually any length of the ferrule to be crimped in intimate contact with the hose. A spiral groove in the outer periphery of each of the roller dies further promotes displacement of the crimper along the length of the ferrule. A connecting link and a manually operated draw bolt connect respective adjacent ends of the carrier plates of the two carrier dies to form a closed frame containing the four roller dies and including a pivoting joint at each of its four corners. The pivoting joints coupling its four frame member essentially eliminate friction within the crimper allowing the roller dies to tightly and uniformly engage the ferrule's outer periphery in forming a strong, smooth, highly uniform circular crimp. Another embodiment contemplates attachment of the roller dies to a locking pliers.

39 Claims, 8 Drawing Sheets

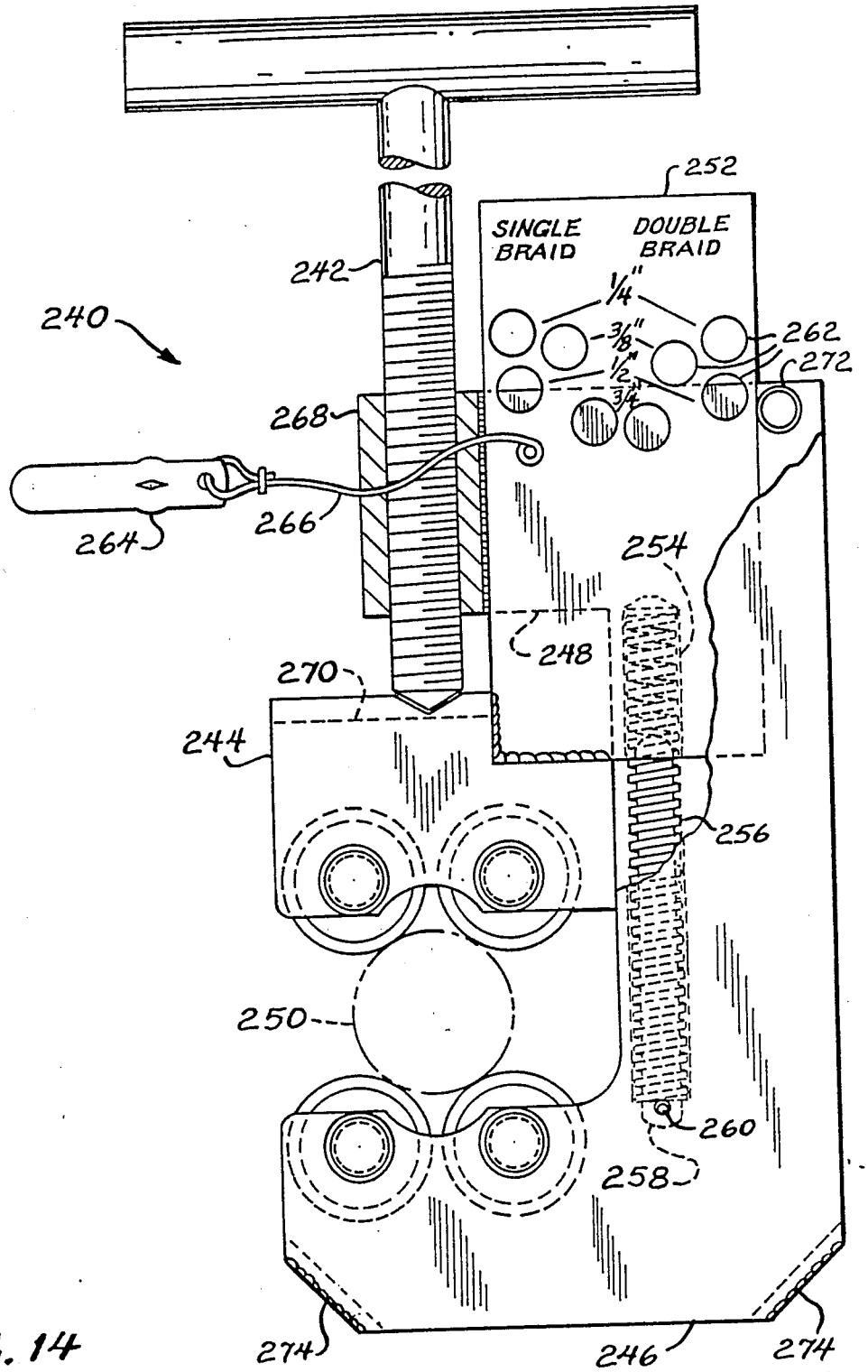
FIG. 13
FIG. 14
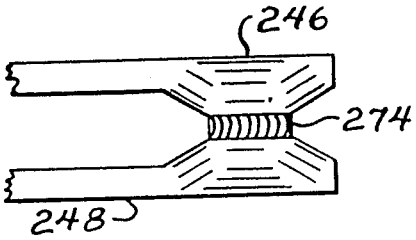

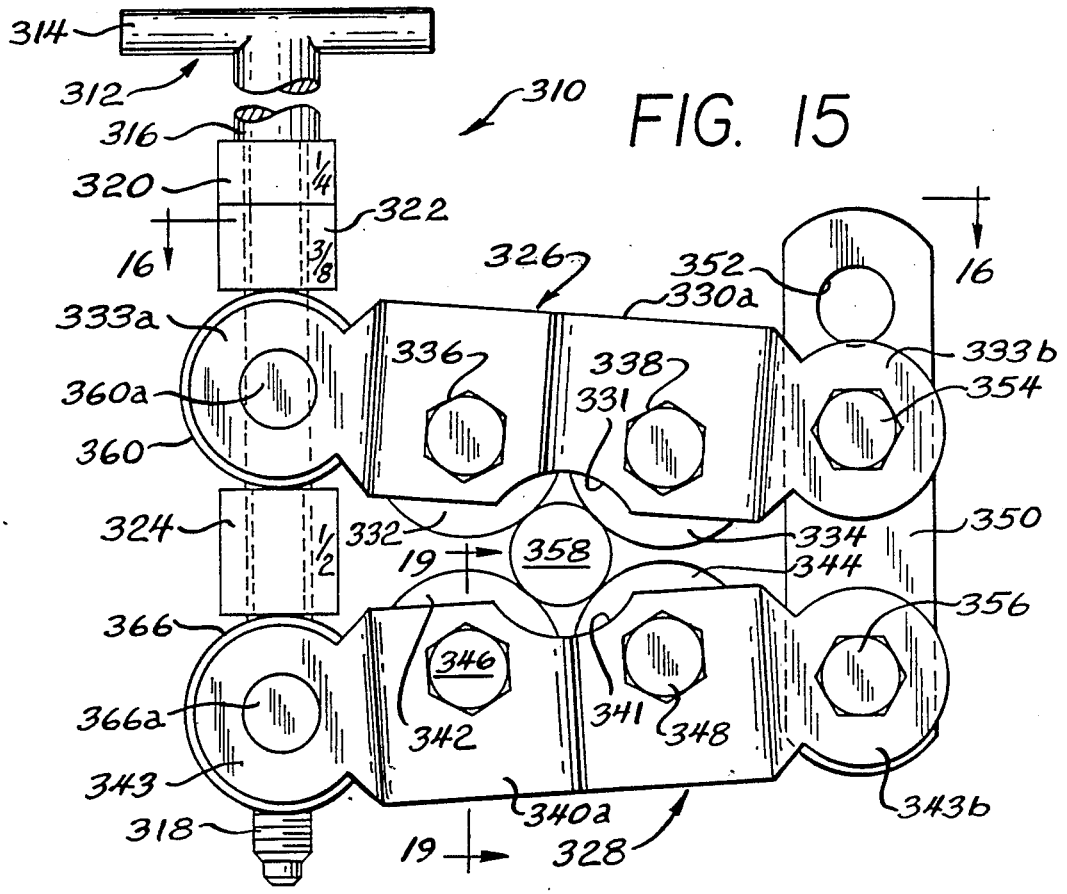
FIG. 15
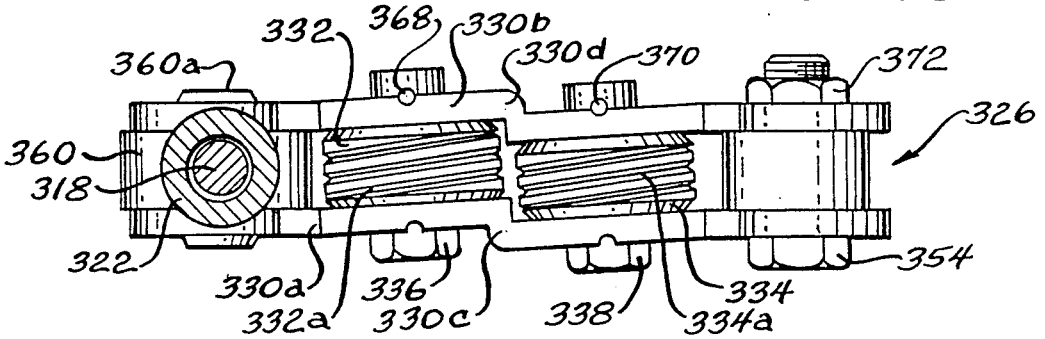
FIG. 16
FIG. 17
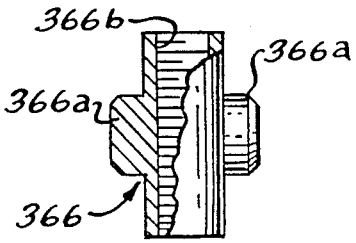
FIG. 18
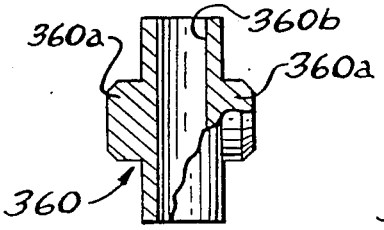
FIG. 19
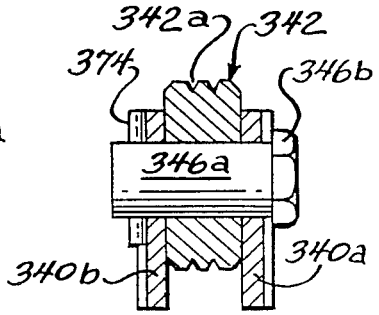

FIG. 27
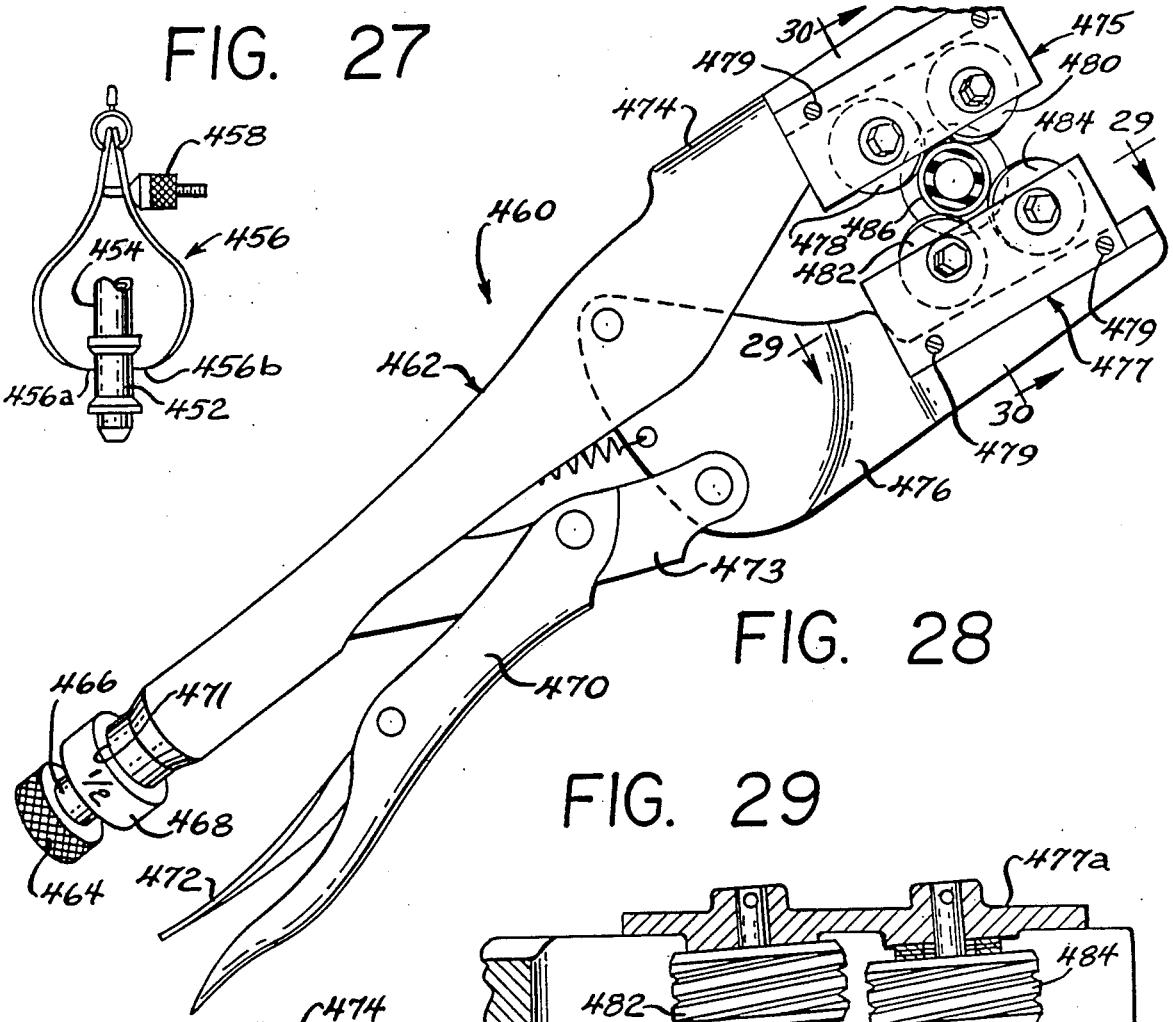
FIG. 28
FIG. 29
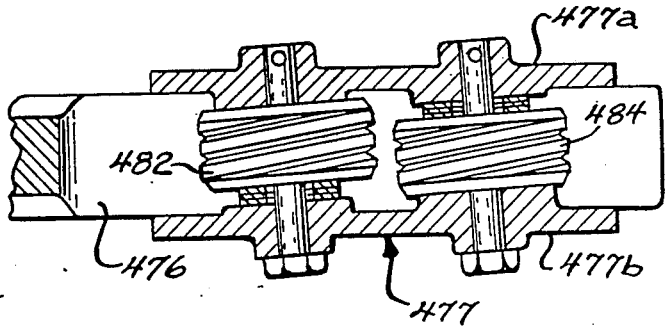
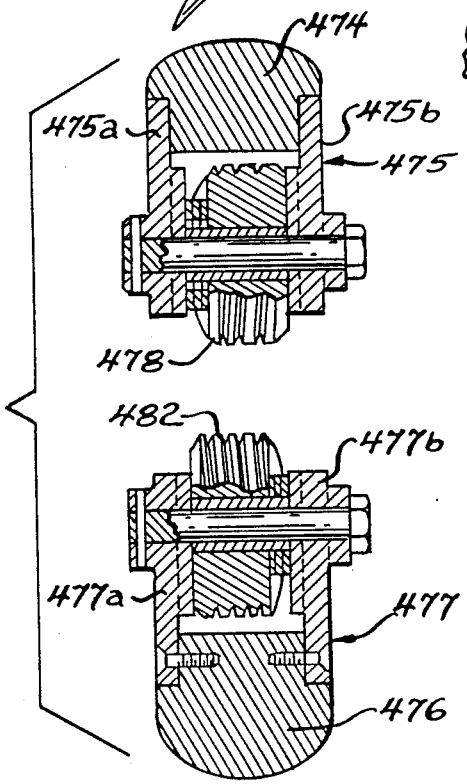
FIG. 30

MANUAL HOSE END CRIMPER

This application is a continuation-in-part of my pendinq application Ser. No. 197,155, filed May 23, 1988 now Pat. No. 4,848,121.

BACKGROUND OF THE INVENTION

This invention relates generally to metal working apparatus and is particularly directed to a manually operated crimper for securing a fitting such as a ferrule to the end of a hose.

A ferrule, which is in the form of a rigid, tubular metal fitting, is generally attached to a hose end by a crimping, or swaging, process. During crimping, or swaging, the ferrule is mechanically compressed inwardly around its periphery so as to securely engage the outer surface of the hose. In this manner, a leak-free coupling is formed between the hose and ferrule for use in a closed, pressurized hydraulic system. With one end of the ferrule crimped to the end of the hose, its other end is frequently provided with threads to permit the hydraulic hose to be coupled to a hydraulically actuated and driven device. Such closed hydraulic systems are commonly used in agricultural applications such as in tractors, combines, etc.

Most prior art crimping arrangements are of the permanent, fixed installation type and are not adapted for use on-site or in the field. These fixed-type crimping arrangements also tend to be somewhat complex and expensive. Portable crimping devices are generally manually operated and are capable of use at remote sites to repair leaking hydraulic connections. Manually operated crimpers typically require a vise for maintaining the ferrule in a fixed position while the crimper engages the ferrule about its periphery and forms a narrow area of compression on the ferrule It is the compressed area of the ferrule which engages the hose in a sealed manner.

The narrow crimped band around the ferrule engages the hose around its periphery over a short length of the ferrule and thus affords only limited protection against fluid leakage. In addition, because the ferrule compression area is of a very limited width, deformation of the ferrule during crimping frequently causes structural fatigue and cracking of the ferrule resulting in its eventual failure. Other manually operated hose end connecting tools require a special soft metal, or aluminum, ferrule because of the limited compressive force which they are capable of exerting. These types of ferrules are generally more expensive and difficult to obtain than conventional ferrules comprised of more commonly used metals and alloys.

The present invention is intended to overcome the aforementioned limitations of the prior art by providing a low cost, manually operated, portable hose end crimping device for securely affixing a ferrule to the end of a hose. The manual hose end crimper provides an extended ferrule compression area which is formed in a step-wise, incremental diameter reducing manner which subjects the ferrule to limited stress and reduces the likelihood of structural fatigue, cracking and ferrule destruction. The manual hose end crimper is adapted for use with ferrules having a wide range of diameters, with the crimper easily and precisely adjusted to a given ferrule size.

OBJECTS AND SUMMARY OF THE INVENTION

Accordingly, it is an object of the present invention to provide an improved apparatus for crimping a rigid, tubular fitting such as a ferrule on the end of a hose.

It is another object of the present invention to provide a manually operated and adjusted hose end crimping device which is capable of accommodating a wide range of hose end fitting diameters.

Yet another object of the present invention is to provide crimping engagement for a ferrule on the end of a hose which is substantially greater than the crimping engagement currently available.

A further object of the present invention is to provide an arrangement for securely attaching a ferrule on the end of a hose which affords crimping engagement of the ferrule with the hose along substantially the entire length of the ferrule.

A still further object of the present invention is to provide apparatus for crimping a ferrule on a hose end in a tight fitting manner, wherein the extent, or strength, of crimping engagement may be selected over a wide, virtually continuous range of values.

Still another object of the present invention is to provide the combination of a ferrule mounting arrangement and a ferrule crimping device which is manually operated, inexpensive, portable, adjustable over a wide range of ferrule sizes, and allows for continuous crimping of a ferrule over substantially its entire length.

Another object of the present invention is to provide an apparatus and method for crimping a ferrule on the end of a hose which minimizes the possibility of damaging the ferrule.

It is still another object of the present invention to provide an apparatus for engaging and swaging a ferrule onto a hose end in a spiral tracking manner so that there is a continuous crimp between the ferrule and the hose end over a given length of the ferrule which may be established as desired.

Another object of the present invention is to provide a manually operated ferrule crimping device which essentially eliminates frictional forces within the crimping device to provide uniform, tighter crimping about the periphery of the ferrule.

Still another object of the present invention is to reduce the cost of a manually operated hose end crimping apparatus by simplifying its structure and reducing the number of different components of the crimper.

A further object of the present invention is to provide a ferrule crimping arrangement particularly adapted for use in locking pliers, or vise grip.

A still further object of the present invention is to provide a ferrule crimper wherein the positions of the ferrule engaging elements more closely approach the shape of the ferrule's outer periphery and a greater, more uniform compressive force may be exerted upon the ferrule.

The present invention contemplates a manually operated apparatus for crimping a ferrule onto the end of a hose. The manually operated crimping apparatus includes a plurality of roller means each having associated therewith respective axes of rotation; a plurality of carrier means for engaging and supporting respective ones of the roller means in spaced relation; first pivotal coupling means for pivotally coupling adjacent first ends of each of the plurality of carrier means in a rotationally displaceable manner; a plurality of second pivotal coupling means each attached to respective adjacent second ends of the plurality of carrier means; and manual control means coupled to each of the plurality of second pivotal coupling means for adjusting the spacing between the plurality of carrier means in positioning the plurality of roller means in tight fitting engagement with a ferrule disposed therebetween so as to exert a compressive force on the ferrule; wherein the rotational axes of the roller means are oriented at an angle relative to a longitudinal axis of the ferrule such that rotation of the crimping apparatus about the ferrule's longitudinal axis causes the roller means to follow a spiral path along the length of the ferrule in crimping the ferrule to the end of the hose.

The present invention further contemplates a manually operated apparatus for crimping a ferrule onto the end of a hose comprising: a locking pliers including first and second spaced members, movable gripping means coupled to the spaced members for moving the members toward and away from one another, and locking means for establishing the first and second members in fixed, spaced relation from each other; and first and second roller means respectively attached to the first and second members and adapted to securely engage a lateral surface of a ferrule disposed therebetween, wherein each of the roller means has an associated axis of rotation and wherein the rotational axes of the first and second roller means are oriented at an angle relative to a longitudinal axis of the ferrule such that rotation of the crimping axis about the ferrule's longitudinal axis causes the roller means to follow a spiral path along the length of the ferrule in crimping the ferrule to the end of a hose.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 13 is a planar view shown partially cutaway and partially in phantom of yet another embodiment of a manual crimping apparatus in accordance with the present invention;

FIG. 14 is an end-on view of a lower corner of the manual crimping apparatus of FIG. 13 illustrating details of its construction;

FIG. 15 is a planar view shown partially in phantom of a manual hose end crimper in accordance with the present invention;

FIG. 16 is a sectional view of the manual hose end crimper shown in FIG. 15 taken along sight line 16—16 therein;

FIG. 17 is a partially cutaway view of a pivotal nut for use in a portion of the manual hose end crimper shown in FIG. 15;

FIG. 18 is a partially cutaway view of a pivotal guide block for use in the manual hose end crimper shown in FIG. 15;

FIG. 19 is a sectional view of a portion of the manual hose end crimper shown in FIG. 15 taken along sight line 19—19 therein;

FIG. 27 shows a caliper as used to measure the outer diameter of the crimped portion of a ferrule in accordance with one embodiment of the present invention;

FIG. 28 is a plan view shown partially in phantom of a locking pliers, or vise grip, arrangement adapted for use as a manual hose end crimper in accordance with another embodiment of the present invention;

FIG. 29 is a sectional view of the locking pliers manual crimper shown in FIG. 28 taken along sight line 29—29 therein; and FIG. 30 is a sectional view of the locking pliers manual crimper shown in FIG. 28 taken along sight line 30—30 therein.

DETAILED DESCRIPTION OF THE PREFERRED EMBODIMENTS

Figure 1:
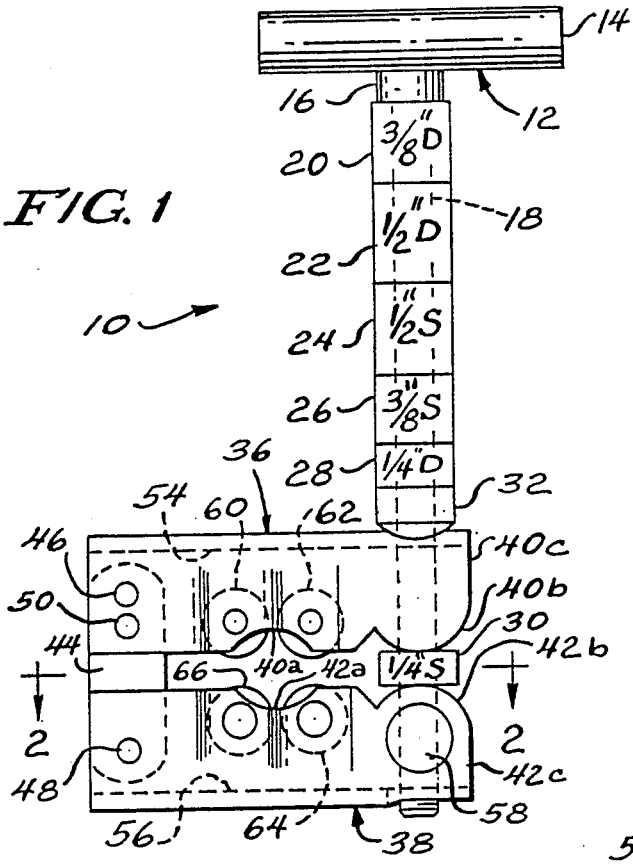
FIG. 1 is a planar view shown partially in phantom of a manual hose end crimper in accordance with the present invention.

Referring to FIG. 1, there is shown a planar view partially in phantom of a manual hose end crimper 10 in accordance with the principles of the present invention. The manual hose end crimper 10 includes a "T"-shaped draw bolt 12 coupled to the combination of first and second engaging members 36 and 38. The "T"-shaped draw bolt 12 includes a gripping portion, or handle, 14 and a threaded shaft 18 which are oriented generally transversely to one another. Disposed on the proximal end of the threaded shaft 18 and in contact with the gripping portion 14 of the "T"-shaped draw bolt 12 is a spacer washer 16. The threaded shaft 18 is inserted through a plurality of bushing shaped gauge blocks 20, 22, 24, 26 and 28 as well as through a pivoting thrust washer 32. The threaded shaft 18 is further inserted through yet another gauge block 30 disposed between the first and second engaging members 36, 38, with the distal end of the threaded shaft inserted through and engaging a threaded pivotal alignment bushing 58 coupled to the second engaging member. The "T"-shaped draw bolt 12 is pivotally displaceable relative to the first engaging member 36 by means of the pivoting thrust washer 32. Similarly, the "T"-shaped draw bolt 12 is pivotally displaceable relative to the second engaging member 38 by means of the alignment bushing 58 which is free to pivot within the second engaging member. Each of the gauge blocks 20, 22, 24, 26 and 28 are respectively used with ⅜" double (D) gauge, ½" D gauge, ½" single (S) gauge, ⅜" S gauge, and ¼" D gauge hose as further described below. Gauge block 30 is disposed between and in contact with the first and second engaging members 36, 38 and provides proper spacing therebetween for a ¼" single gauge hose as described below. Finally, each of the gauge blocks is labeled with the size of the ferrule with which it is intended for use.

The right hand portions of the first and second engaging members 36, 38 as viewed in FIG. 1 are thus displaced toward one another and in intimate contact with the ¼" S gauge block 30 by rotationally displacing the "T"-shaped draw bolt 12. Rotational displacement of the "T"-shaped draw bolt 12 in a first direction thus draws the pivoting thrust washer 32 and the alignment bushing 58 toward one another forcing a curved portion **40*b* of the first engaging member 36 in intimate contact with the ¼" S gauge block and a corresponding curved portion 42*b* of the second engaging member 38 also in intimate contact with the ¼" gauge block. The respective curved portions 40*b* and 42*b* of the first and second engaging members 36 and 38 as well as the curved portion of the pivoting thrust washer 32 allow the draw bolt 12 to pivot relative to the first and second engaging members to accommodate the positioning of gauge blocks having different thicknesses between the engaging members. The thickness of the gauge block positioned between and in contact with the first and second engaging members 36, 38** is determined by the outer diameter of the ferrule to be crimped and the size of the hose.

The left hand portions of the first and second engaging members 36, 38 as shown in FIG. 1 are coupled together by means of the combination of a connecting bar 44 and first and second connecting pins 46 and 48. The first connecting pin 46 is inserted through a pair of spaced apertures within the first engaging member 36, while the second connecting pin 48 is inserted through a pair of spaced apertures in the second engaging member 38. In addition, the first connecting pin 46 is inserted through an aperture at one end of the elongated, linear connecting bar 44, while the second connecting pin 48 is inserted through a second aperture at the other end of the connecting bar. The first and second connecting pins 46, 48 provide pivoting displacement between each of the first and second engaging members 36, 38 and the connecting bar 44. A second set of apertures 50 is provided for in the first engaging member 36 to allow for increased separation between the first and second engaging members 36, 38 when coupled together by the connecting bar 44. Increased displacement between the engaging members is required for larger diameter ferrules as described below.

Figure 5:
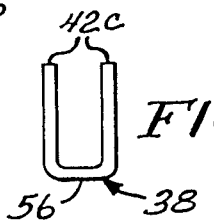
FIG. 5 is an end-on view of the lower roller die carrier portion of the manual hose end crimper illustrated in FIG. 1.

Each of the first and second engaging members 36, 38 is preferably in the form of an elongated, U-shaped structure such as shown in the end view of the second engaging member 38 in FIG. 5. Thus, the second engaging member 38 includes a pair of spaced side walls **43*c* coupled together at adjacent ends and along the length thereof by an end wall 56. Similarly, the first engaging member 36 includes a pair of spaced side walls 40*c* joined together along their respective upper edges by an end wall 54. The U-shaped structural configuration of the first and second engaging members 36, 38** is preferably comprised of a unitary piece of forged metal such as steel.

Each of the first and second engaging members 36, 38 further includes two additional pairs of facing apertures therein. Disposed within each pair of spaced apertures in each of the engaging members is a bearing pin on which is rotationally disposed a respective roller die. Thus, first and second roller dies 60, 62 are coupled to and positioned within the first engaging member 36, while third and fourth roller dies 64, 66 are positioned within and coupled to the second engaging member 38. Each of the bearing pins permits the roller die to which it is coupled to be rotationally displaced within an engaging member. The first and second engaging members 36, 38 also include respective facing recessed portions **40*a* and 42*a* disposed immediately adjacent to and between respective pairs of roller dies. Thus, the first and second roller dies 60, 62 are partially positioned within the recessed portion 40*a* of the first engaging member 36. Similarly, the third and fourth roller dies 64, 66 are partially positioned within and extend beyond the recessed portion 42*a* of the second engaging member 38. Each of the roller dies, as shown for the case of the first roller die 60 in FIG. 3, includes an aperture 60*a* through which a respective bearing pin is inserted. Each of the roller dies further includes a pair of facing tapered edges shown as elements 60*b* in FIGS. 3 and 4 for the case of the first roller die 60. Finally, each of the roller dies also includes a spiral groove on its outer peripheral surface shown as element 60*c* for the case of the first roller die 60 illustrated in FIG. 4**.

The manual crimper 10 operates in the following manner to securely engage a ferrule for the purpose of crimping the ferrule onto the end of a hose. With the outer diameter of the ferrule known, the corresponding gauge block is positioned about the threaded shaft 18 of the "T"-shaped draw bolt 12 and is spaced between the first and second engaging members 36, 38 and in contact with their respective facing curved portions. This may be accomplished by removing the "T"-shaped draw bolt 12 from the threaded pivotal alignment bushing 58 and withdrawing it from the pivoting thrust washer 32.

The appropriate gauge block as determined by the outer diameter of the selected ferrule is then slid off the threaded shaft 18 and removed from the "T"-shaped draw bolt 12. With the desired gauge block disposed between the first and second engaging members 36, 38 and in alignment with the alignment bushing 58, the threaded shaft 18 is then threaded through the alignment bushing so as to draw the first and second engaging members 36, 38 toward each other and in intimate contact with the gauge block disposed therebetween, as shown for the case of the ¼" S gauge block 30 in FIG. 1. Each of the first and second engaging members 36, 38 is free to rotate about a respective end of the connecting bar 44 by means of one of the respective connecting pins 46 and 48. Before tightening the "T"-shaped draw bolt 12 and drawing the first and second engaging members 36, 38 toward each other, the ferrule to be crimped is positioned between the four roller dies 60, 62, 64 and 66. With the ferrule disposed in the space defined by the four aforementioned roller dies, the "T"-shaped draw bolt 12 is then rotationally displaced so as to draw the first and second engaging members 36, 38 toward each other and in intimate contact with the gauge block 30. The thickness of the gauge block 30 ensures that the spacing between the first and second roller dies 60, 62 and the third and fourth roller dies 64, 66 is such that the ferrule disposed therebetween is tightly crimped by the four aforementioned roller dies as the manual crimper 10 is rotationally displaced about the ferrule. For large diameter ferrules, the first connecting pin 46 may be removed from the first pair of aligned apertures in the first engaging member 36 and inserted through a second pair of apertures 50 within the first engaging member to permit a larger sized ferrule to be positioned between the aforementioned four roller dies. A corresponding larger gauge block would then be positioned between the respective convex portions **40*b* and 42*b* of the first and second engaging members 36 and 38**.

Figure 2:
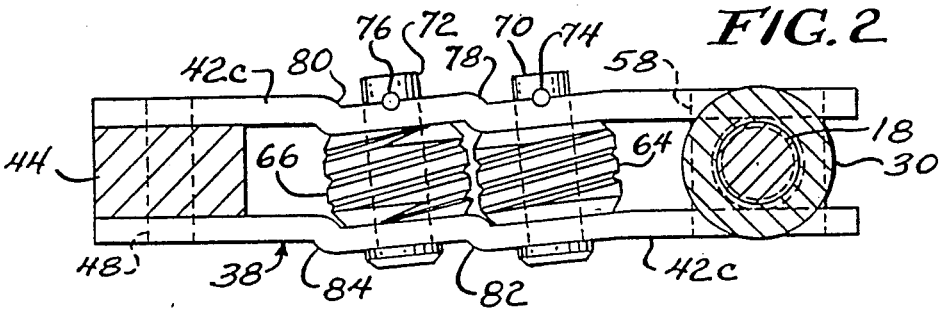
FIG. 2 is a sectional view of the manual hose end crimper illustrated in FIG. 1 taken along sight line 2—2 therein.

Referring to FIG. 2, there is shown a sectional view of the manual crimper illustrated in FIG. 1 taken along sight line 2—2 therein. The sectional view of FIG. 2 illustrates the details of the manner in which the pair of third and fourth roller dies are positioned within and coupled to the second engaging member 38. A similar arrangement is provided for in mounting the first and second roller dies 60, 62 in the first engaging member 36. As shown in FIG. 2, the second connecting pin 48 is inserted through facing apertures in the side walls of the second engaging member 38 as well as through the connecting bar 44. At the other end of the second engaging member the threaded pivotal alignment bushing 58 shown in dotted line form is also inserted through facing apertures in the side portions of the second engaging member. Inserted within and threadably engaging the gauge block 30 is the threaded shaft 18.

A bearing pin 70 is inserted through spaced apertures in the facing side portions of the second engaging member 38 as well as through an aperture in the third roller die 64. Similarly, another bearing pin 72 is inserted through spaced apertures in the facing side portions of the second engaging member 38 as well as through the aperture in the fourth roller die 66. As previously described with respect to the first roller die 60 and as illustrated in FIG. 2, each of the third and fourth roller dies 64, 66 is provided with a similar spiral groove in its outer, peripheral surface. Each of the third and fourth roller dies 64, 66 further includes a tapered edge on facing outer lateral portions thereof. Each of the bearing pins 70, 72 includes an enlarged head end as well as an aperture adjacent to the opposite end thereof. Retaining pin 74 is inserted through the aperture in bearing pin 70, while retaining pin 76 is inserted through the aperture in bearing pin 72. Each of these retaining pins is preferably inserted in a respective slot on the outer surface of the second engaging member 38 in order to maintain it securely in position and inserted through its associated bearing pin. Thus, retaining pins 74 and 76 respectively maintain bearing pins 70 and 72 securely in position within the second engaging member 38.

Figure 3:
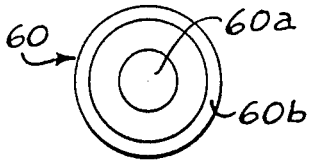
FIG. 3 is a planar view of a roller die used in the manual hose end crimper of the present invention.
Figure 4:
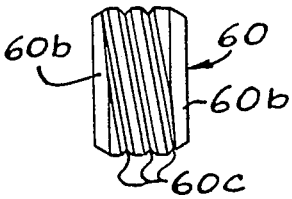
FIG. 4 is an end-on view of the manual hose end crimper roller die illustrated in FIG. 3.

As shown in FIG. 2, as well as in the shaded portions of the manual crimper 10 shown in FIG. 1 and in accordance with the present invention, each of the roller dies is oriented at an angle relative to the lengthwise dimensions of the first and second engaging members 36, 38. Thus, the upper side wall of the second engaging member 38 as shown in FIG. 3 includes first and second angled portions 78, 80 while the lower side wall **42*c* includes third and fourth angled portions 82 and 84. Each pair of angled portions in the side walls of the second engaging member 38 provides each of the roller dies 64 and 66 with an axis of rotation which is not perpendicular to a plane defined by the first and second engaging members 36, 38 and the threaded shaft 18 of the "T"-shaped draw bolt 12. Thus, with a ferrule (not shown) inserted between and engaged by each of the four roller dies 60, 62, 64 and 66, rotation of the manual crimper 10 about the ferrule in a direction generally perpendicular to its longitudinal axis will cause the manual crimper to track along the outer surface of the ferrule in a spiral rather than a circular path. In this manner, the manual crimper 10** of the present invention crimps the surface of the ferrule along the length thereof. An extended ferrule compression area may thus be crimped onto a hose for more secure engagement between the ferrule and hose end.

It should be noted that the first and second roller dies 60, 62 are provided with spaced, parallel axes of rotation, while the third and fourth roller dies 64, 66 are also provided with spaced, parallel axes of rotation. It should also be noted that the axes of rotation of the first and second rollers 60, 62 are not aligned with and parallel to the axes of rotation of the third and fourth roller dies 64, 66, as described below. It is the angled orientation of each of the four aforementioned roller dies relative to the longitudinal axis of a ferrule disposed between and in contact with these roller dies which permits the manual crimper 10 of the present invention to crimp the ferrule along a spiral path extending along the length of the ferrule. The spiral grooves in each of the four aforementioned roller dies further assists in the spiral tracking of the manual crimper 10 as it is rotated about a ferrule positioned therein and engaged thereby. The extent of engagement between the ferrule and hose end as established by the length of the ferrule compression area may be selected as desired by the operator of the hose end crimper. Thus, where more secure fittings are required, a larger length of the ferrule may be securely crimped in intimate contact with the hose end. In some applications, it may be desirable to crimp the ferrule along its entire length in order to provide a high degree of engagement between the ferrule and hose end.

Figure 7:
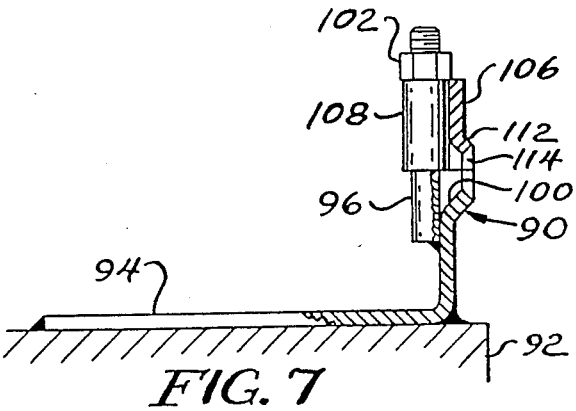
FIG. 7 is a sectional view of the ferrule retainer illustrated in FIG. 6 taken along sight line 7—7 therein.
Figure 6:
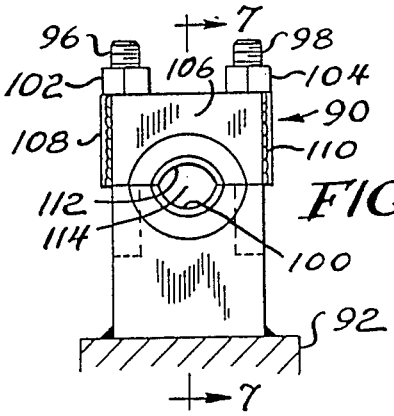
FIG. 6 is an end-on view of a ferrule retainer for use with the manual hose end crimper of the present invention.
Figure 8:
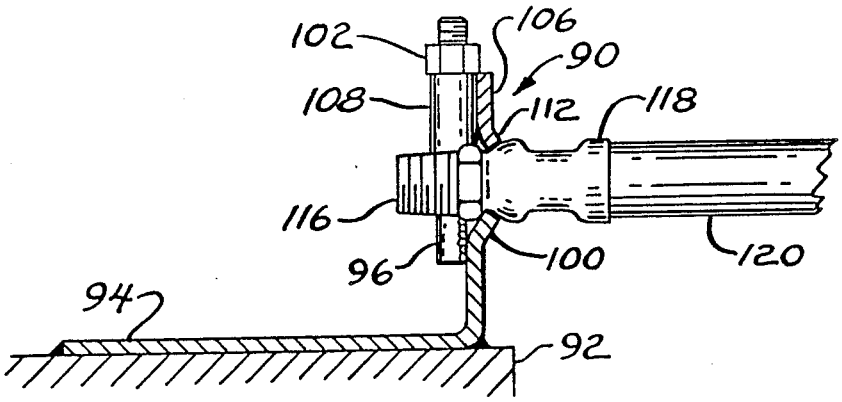
FIG. 8 is a lateral view shown partially in section of the retainer mechanism of FIGS. 6 and 7 illustrating the manner in which the retainer mechanism engages and supports a ferrule during crimping.

Referring to FIGS. 6 and 7, there are respectively shown end-on and side views of a hose end retainer 90 for use with the manual crimper of the present invention. The hose end retainer 90 includes an angle 94 securely attached to a support structure 92 by conventional means such as weldments. Coupled to the angle 94 are first and second threaded pins 96 and 98. The first and second threaded pins 96, 98 are positioned adjacent to respective opposed lateral edges of the angle 94 and extend upward and beyond the angle. An upper, center edge of the angle 94 is provided with a first concave lip 100 which extends outward and upward from the angle as shown in FIG. 7. Hose end retainer 90 further includes a plate 106 to which are securely attached in spaced relation first and second mounting sleeves 108 and 110. As in the case of the first and second threaded pins 96, 98, the first and second mounting sleeves 108, 110 are attached to plate 106 by conventional means such as weldments. The first and second mounting sleeves 108, 110 are respectively adapted for positioning over and receiving the first and second threaded pins 96, 98. A center portion of the lower edge of plate 106 is provided with a second concave lip 112. With the first and second threaded pins 96, 98 respectively inserted in the first and second mounting sleeves 108, 110, the first and second concave lips 100, 112 define a generally oval, or circular, aperture in the hose end retainer 90, which is adapted to receive and engage a ferrule 118 positioned therein as shown in FIG. 8, which is a lateral sectional view illustrating the manner in which the retainer engages and retains a rigid, tubular ferrule. The first and second concave lips 100, 112 extend outward from the plane of the ferrule engaging portion of the hose end retainer 90 to facilitate secure engagement and retention of a ferrule 118 by the retainer. The size of the aperture 114 defined by the first and second concave lips 100, 112 is determined by the size of the ferrule. With each of the aforementioned lips in intimate contact with the ferrule disposed therebetween, first and second nuts 102, 104 positioned on the first and second threaded pins 96, 98 are tightened downwardly on the first and second mounting sleeves 108, 112 in displacing the plate 106 downward and forcing the first and second concave lips 100, 112 in intimate contact with the outer periphery of a ferrule 118 disposed within the aperture 114.

As shown in FIG. 8, a hose 120 is inserted in one end of the ferrule 118 while a threaded fitting 116 is attached to the other end of the ferrule. The ferrule 118 is crimped on one end thereof to ensure that it is securely coupled to and engages the threaded fitting 116. The ferrule 118 is then positioned between the first concave lip 100 of the angle 94 and the second concave lip 112 of the plate 106. The first and second nuts 102, 104, which may also be in the form of wing nuts, are then tightened on the first and second threaded pins 96, 98 so as to engage and displace downward the combination of the first and second mounting sleeves 108, 110 and the plate 106. In this manner, the ferrule 118 is securely engaged about a substantial portion of its outer periphery by the first and second concave lips 100, 112. With the ferrule 118 thus maintained in a fixed position and orientation by the hose end retainer 90, the ferrule may then be crimped over the end of the hose 120 to ensure secure engagement therebetween. The distal end of the ferrule 118 is typically bell-shaped, or beveled, to reduce the possibility of cutting the hose 120 during operation.

Figure 9:
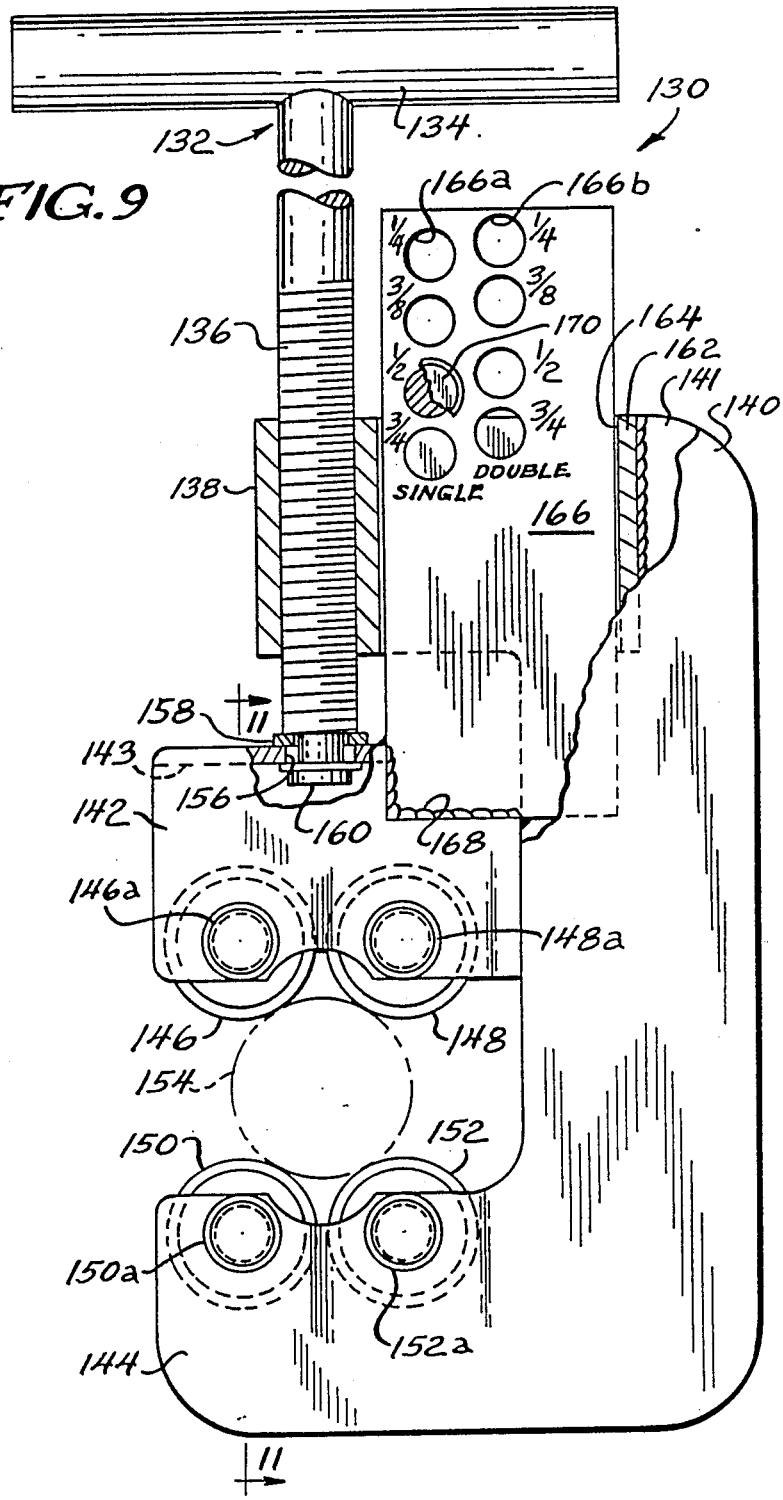
FIG. 9 is a partially cutaway planar view shown also partially in phantom of another embodiment of a manual hose end crimper in accordance with the present invention.

Referring to FIG. 9, there is shown another embodiment of a manual crimper 130 in accordance with the present invention. The manual crimper as shown in FIG. 9 includes a pair of spaced C-shaped plates 140 and 141. Each of the C-shaped plates 140 is generally planar, with the plates arranged in spaced, parallel alignment as shown in G. 11, which is a sectional view of the manual crimper 130 illustrated in FIG. 9 taken along sight line 11—11 therein. The upper ends of each of the C-shaped plates 140 and 141 are coupled together by means of an elongated hex nut 138 which is attached to each of the C-shaped plates and extends therebetween. An elongated, flat guide sleeve 162 is also coupled to the inner surfaces of each of the C-shaped plates 140 and 141 by conventional means such as a weldment. The space between and defined by the C-shaped plates 140 and 141, hex nut 138, and guide sleeve 162 forms a slot 164.

Disposed within and engaging the hex nut 138 is the threaded shaft 136 of a "T"-shaped draw bolt 132. The "T"-shaped draw bolt 132 further includes a gripping portion, or handle, 134. Rotation of the "T"-shaped draw bolt 132 within the hex nut 138 displaces the draw bolt as well as a roller die carrier 142 coupled to the lower end thereof either upward or downward depending upon the direction of rotation. The lower end of the threaded shaft 136 is inserted through an aperture 156 within an upper, end wall 143 of the roller die carrier 142. A thrust washer 158 is disposed between the threaded shaft 136 and the end wall 143 of the roller die carrier 142 to facilitate rotational displacement of the "T"-shaped draw bolt 132 within the roller die carrier. A snap ring 160 positioned on the lower end of the threaded shaft 136 maintains coupling between the "T"-shaped draw bolt 132 and the roller die carrier 142.

The roller die carrier 142 further includes a pair of spaced, parallel walls coupled to and continuous with the end wall 143 at their respective upper ends. Positioned between the two side walls of the roller die carrier 142 are first and second roller dies 146, 148. The first and second roller dies 146, 148 are positioned on and maintained in position within the roller die carrier 142 by bearing pins **146*a* and 148*a*, respectively. Each of the bearing pins 146*a*, 148*a* is inserted through a pair of apertures in the roller die carrier 142 to permit the first and second roller dies 146, 148 to be rotationally displaced within the roller die carrier. As shown for the case of bearing pin 146*a* in FIG. 11, each of the aforementioned bearing pins is maintained in position within the roller die carrier 142 by means of a respective retaining pin 178. Alternatively, a single retaining pin may be inserted through the aligned apertures of the bearing pins 146*a* and 148*a* as well as into a slot in the outer surface of the roller die carrier 142** for maintaining it in position.

The lower portions of the pair of spaced, parallel C-shaped plates 140 and 141 form a die roller support structure 144 having two pairs of aligned, spaced apertures therein. A bearing pin **150*a* is positioned within one pair of spaced, aligned apertures, while another bearing pin 152*a* is inserted within a second pair of spaced, aligned apertures within the C-shaped plates 140 and 141. Bearing pin 150*a* is inserted through a third roller die 150, while bearing pin 152*a* is inserted through a fourth roller die 152. Each of the third and fourth roller dies 150, 152 is free to rotate within the manual crimper 130. Each of the bearing pins 146*a*, 148*a* is maintained in position so as to extend between the C-shaped plates 140 and 141 by means of a respective retainer pin 180 as shown in FIG. 11**.

A guide/alignment bar 166 is coupled to the roller die carrier 142 by conventional means such as a weldment 168. The guide/alignment bar 166 is in the general form of a planar, elongated plate which is disposed within a slot between the C-shaped plates 140 and 141 and further defined by hex nut 138 and guide sleeve 162. Rotational displacement of the "T"-shaped draw bolt 132 within the hex nut 138 causes upward or downward displacement of the roller die carrier 142 as well as the guide/alignment bar 166 disposed within the slot 164. The guide/alignment bar 166 includes a plurality of spaced gauge pin apertures **166*a*, 166*b* each of which is adapted to receive a gauge/stop pin 170. The alignment and spacing of the gauge pin apertures 166*a*, 166*b* defines the spacing between the first and second roller die combination and the third and fourth roller die combination. With a ferrule 154 disposed between the first and second roller combination and the third and fourth roller combination, the "T"-shaped draw bolt 134 is rotated so as to lower the roller die carrier 142 toward the roller die support structure 144 of the two C-shaped plates 140 and 141. The roller die carrier 142 is moved toward the roller die support structure 144 of the manual crimper 130 until the gauge/stop pin 170 inserted in one of the gauge pin apertures engages the upper edges of the pair of C-shaped plates 140 and 141. Contact between the gauge/stop pin 170 and the C-shaped plates 140 and 141 prevents further downward movement of the roller die carrier 142 and ensures proper spacing between the first and second roller combination and the third and fourth roller combination in accordance with the outer diameter of the ferrule 154. With the four aforementioned roller dies engaging the ferrule 154, the manual crimper 130** is rotationally displaced about the ferrule in order to provide crimping engagement of the ferrule with a hose end inserted therein.

Figure 10:
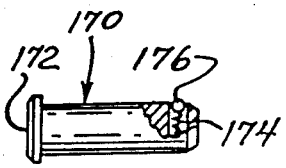
FIG. 10 is a partially cutaway side view of a gauge pin for use in the manual hose end crimper of FIG. 9.

Referring to FIG. 10, there is shown a partially cutaway side view of a gauge/stop pin 170 for use in the manual crimper 130. The gauge/stop pin 170 includes a head portion 172 at a first end thereof and a slot positioned adjacent to a second end thereof. Positioned within the slot is the combination of a coiled spring 174 and a ball 176 which serve to maintain the gauge/stop pin 170 in position within one of the aforementioned gauge pin apertures when inserted in the guide/alignment bar 166.

Figure 11:
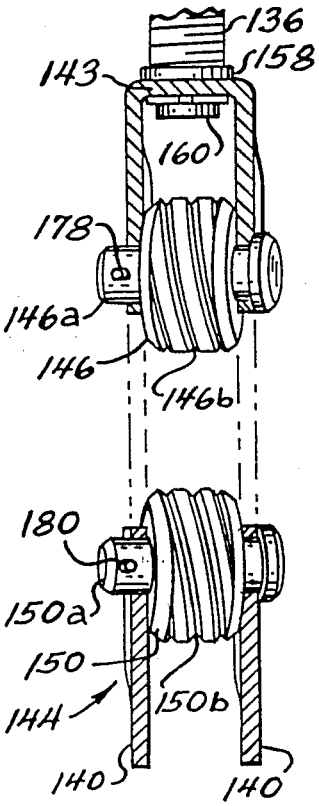
FIG. 11 is a sectional view of the manual hose end crimper of FIG. 9 taken along sight line 11—11 therein.

FIG. 11 illustrates the details of the relative position and orientation of the roller dies in the manual crimper 130. The first and second roller dies 146 and 148 are oriented to the left when viewed end-on as in FIG. 11. Similarly, the third and fourth roller dies, as shown for the case of roller die 150 in FIG. 11, are oriented to the right when viewed end-on. Thus, the two upper roller dies are aligned in a first direction, while the two lower roller dies are oriented in a second direction, where the first and second directions are offset relative to the plane of the roller die carrier 142 and the pair of aligned, parallel C-shaped plates 140 and 141. The rotational axes of the four roller dies are also at an angle relative to the longitudinal axis of the ferrule 154. The relative angled orientation of the roller dies, with the upper and lower roller die pairs facing in non-aligned orientations, allows the manual crimper 130 to trace over the surface of the ferrule 154 during crimping in a spiral path so that the ferrule is crimped along its length. By providing a crimping area of substantial width, more secure engagement is provided between the ferrule and a hose disposed therein. Each of the four roller dies further includes a spiral groove on the outer, circular surface thereof as shown for the case of the first roller die 146 with spiral groove **146*b* and the third roller die 150 with spiral groove 150*b***. It is the angled orientation of the rollers which causes the manual crimper to crimp the ferrule in a spiral path. The spiral grooves in the outer, peripheral surfaces of the roller dies further assists in spiral tracking of the manual crimper on the outer surface of the ferrule and, in combination with the beveled edges of the roller dies, reduces the possibility of splitting or cracking or otherwise damaging the ferrule. The aforementioned beveled edges of the roller dies also facilitate lateral displacement of the manual crimper along the length of the ferrule and provide more gradual and less abrupt bending and deformation of the ferrule thus reducing the likelihood of producing structural fatigue. The roller dies are preferably oriented at an angle of approximately 3° relative to a plane perpendicular to the longitudinal axis of the ferrule and there are preferably six spiral grooves per inch in each of the roller dies.

Figure 12:
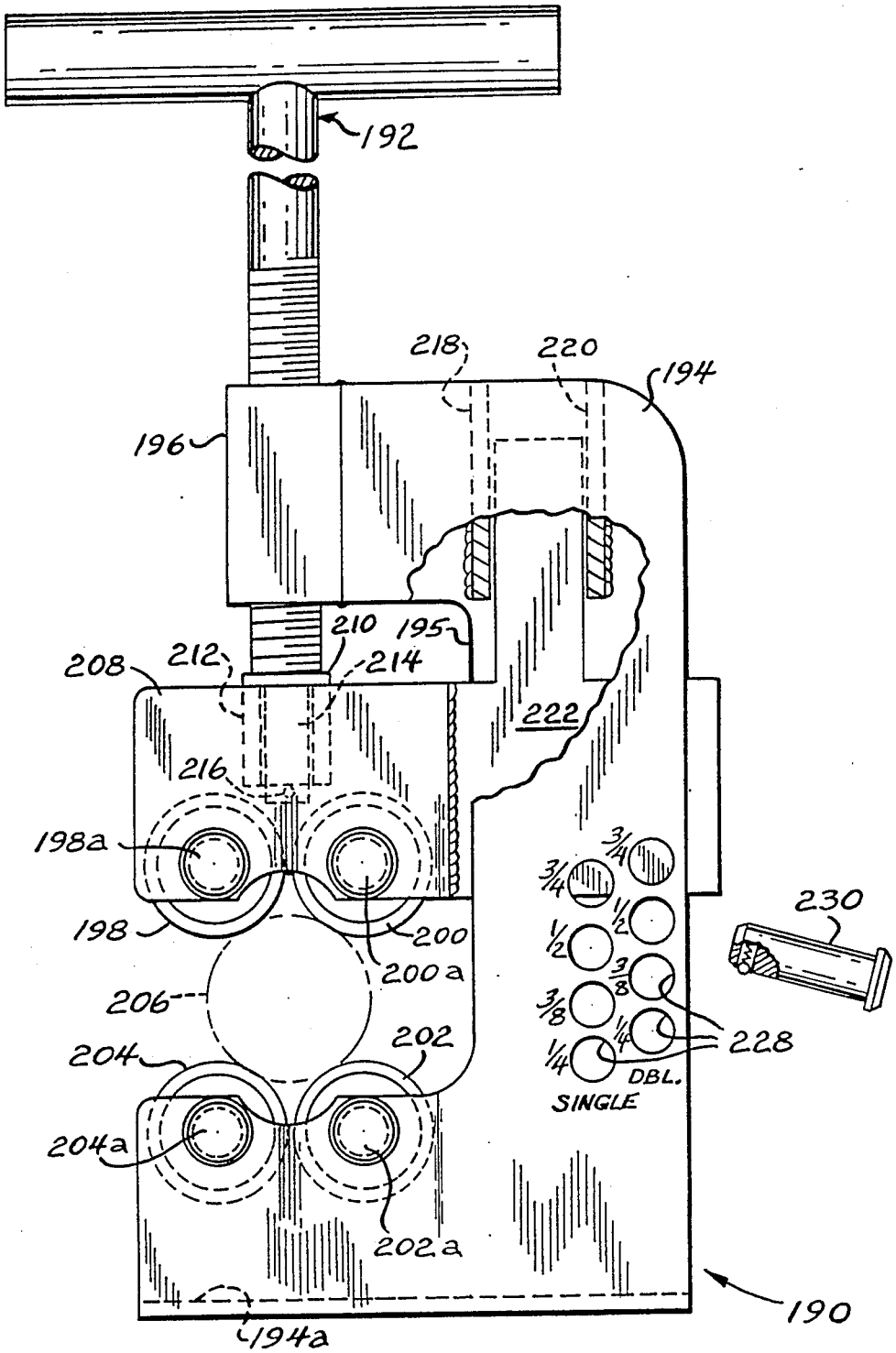
FIG. 12 is a planar view shown partially in phantom and partially cutaway of yet another embodiment of a manual hose end crimper in accordance with the present invention.

Referring to FIG. 12, there is shown a partially cutaway planar view of yet another embodiment of a manual crimper 190 in accordance with the present invention. The manual crimper 190 shown in FIG. 12 also includes a "T"-shaped draw bolt 92 inserted through and engaging a threaded coupling nut 196. The threaded coupling nut 196 is coupled to the upper edges of a pair of generally C-shaped plates 194 and 195 which are arranged in spaced, parallel alignment. The two C-shaped plates 194 and 195 are further coupled together by means of a pair of guide sleeves 218 and 220 which are coupled to each of the C-shaped plates by conventional means such as a weldment. The guide sleeves 218, 220 define a slot between the two C-shaped plates 194 and 195. The lower edges of each of the C-shaped plates 194 and 195 includes a cross member **194*a*, with the cross member of each of these plates coupled together such as by welding along the respective lengths thereof. The two C-shaped plates 194 and 195 are thus securely coupled together and maintained in relative spacing and position by various structural members disposed between and coupled to these plates. The lower end of the "T"-shaped draw bolt 192 includes a machined lower end portion 214 which is inserted within and coupled to a roller carrier 208 by means of a roller pin 216. A carrier bushing, or adapter, 212 inserted in the roller carrier 208 and a thrust washer, or bearing, 210 facilitate rotational displacement of the "T"-shaped draw bolt 192 within and relative to the roller carrier 208. Rotational displacement of the draw bolt 192 causes the roller carrier 208** to be displaced either upward or downward.

Inserted through spaced, aligned apertures in facing portions of the roller carrier 208 are a pair of bearing pins **198*a* and 200*a*. A first roller die 198 is positioned on bearing pin 198*a*, while a second roller die 200 is positioned on bearing pin 200*a*. It is in this manner that the first and second roller dies 198, 200 are mounted in the roller carrier 208** and free to rotate therein.

A second pair of bearing pins **202*a* and 204*a* are positioned within respective aligned, spaced apertures in a lower portion of the C-shaped plates 194 and 195. Bearing pin 202*a* is inserted through a third roller die 202, while bearing pin 204*a* is inserted through a fourth roller die 204. The third and fourth roller dies 202, 204 are thus coupled to and positioned between respective lower portions of the C-shaped plates 194 and 195 and are free to rotate therein. The four roller dies are adapted to receive a ferrule 206** therebetween for crimping the ferrule to a hose end.

Coupled to one end of the roller carrier 204 by conventional means such as a weldment and disposed between the two spaced, facing C-shaped plates 194 and 195 is a guide/alignment bar 222. The guide/alignment bar 222 is generally "T"-shaped and includes an upper portion disposed within the slot defined by the pair of guide sleeves 218 and 220 and the two C-shaped plates 194 and 195. The guide/alignment bar 222 is of the same width as the aforementioned roller dies to facilitate free movement of the roller carrier 208 when the threaded draw bar 192 is rotationally displaced. The right hand portion of the guide/alignment bar 222 which is disposed between the pair of spaced, parallel C-shaped plates 194 and 195 also maintains the roller carrier 208 in alignment as it is linearly displaced within the manual crimper 190.

Intermediate portions of each of the C-shaped plates 194 and 195 are provided with a plurality of spaced, aligned apertures 228. Each pair of aligned, spaced apertures 228 is adapted to receive a gauge/stop pin 230 inserted therein for limiting the downward displacement of the roller carrier 208 and guide/alignment bar 220 combination. The relative spacing and positioning of the apertures 228 is such that each aligned pair of apertures within the C-shaped plates 194 and 195 defines a given spacing between the first and second roller dies 198, 200 and the third and fourth roller dies 202, 204. In this manner, the manual crimper 190 may be adjusted to crimp various ferrules 206 having a range of outer diameters. As to the two embodiments of the invention shown in FIGS. 9 and 12, the embodiment of FIG. 9 is the preferred because the closer proximity of the axis of the threaded shaft of the "T"-shaped draw bolt to the guide/alignment bar produces a reduced torque in the manual crimper during tightening upon the ferrule and essentially eliminates misalignment problems among the various moving parts of the manual crimper.

Referring to FIG. 13 there is shown yet another embodiment of a manual crimper 240 in accordance with the present invention. As in the prior embodiments, the manual crimper 240 shown in FIG. 13 includes a "T"-shaped draw bolt 242 coupled to a movable roller carrier assembly 244. The manual crimper 240 further includes a pair of C-shaped plates 246 and 248 arranged in spaced, parallel alignment which are coupled at one end to a threaded coupling nut 268. The threaded shaft of the "T"-shaped draw bolt 242 is inserted in the threaded coupling nut 268 to permit the movable roller carrier assembly 244 to be moved toward and away from a lower portion of the C-shaped plates 246, 248 which also includes a pair of spaced roller dies therein. Movement of the movable roller carrier assembly 244 and two roller dies therein relative to a second pair of roller dies in the lower portion of the C-shaped plate assembly permits a ferrule 250 to be firmly grasped between the two pairs of roller dies for crimping. Coupled to the movable roller carrier assembly 244 is a guide/alignment bar 252 which includes a plurality of spaced apertures 262 therein. The guide/alignment bar 252 is positioned between the first and second C-shaped plates 246 and 248 and is further positioned between the threaded coupling nut 268 and a free roller pin 272 which is positioned between and coupled to the two C-shaped plates. The movable roller carrier assembly 244 and the guide/alignment bar 252 are coupled by conventional means such as a weldment. Each of the apertures 262 is adapted for receiving a wedge lock gauge pin 264 for establishing the spacing between the upper and lower pairs of roller dies in accordance with the outer diameter of the ferrule 250. A tether line 266 couples the wedge lock gauge pin 264 to the guide/alignment bar 252 to prevent the gauge pin from being lost.

A lower portion of the guide/alignment bar 252 is provided with an elongated, linear slot 254. Inserted in the slot and extending from the guide/alignment bar 252 is a coiled compression spring 256. Positioned within the compression spring 256 and aligned with the slot 254 in the guide/alignment bar 252 is a guide pin 258. One end of the guide pin 258 is provided with an aperture through which a retainer pin 260 is inserted. Opposing ends of the retainer pin 260 are coupled to facing, inner portions of the first and second C-shaped plates 246, 248 for securely mounting the guide pin 258 within the manual crimper 240. The opposing end of the guide pin 258 is free to move within and along the slot 254 within the guide/alignment bar 252. The retainer pin 260 not only serves to attach one end of the guide pin 258 to the first and second C-shaped plates 246, 248, but also serves as an end stop for one end of the coiled compression spring 256. The coiled compression spring 256 urges the combination of the guide/alignment bar 252 and the movable roller carrier assembly 244 to the retracted, or upward, position to eliminate the requirement for secure coupling between the movable roller carrier assembly and the threaded shaft portion of the "T"-shaped draw bolt 242. The arrangement of FIG. 13 thus eliminates the requirement for a rotatable connection between the "T"-shaped draw bolt 242 and the movable roller carrier assembly 244. The lower end of the "T"-shaped draw bolt 242 is provided with a rounded bearing surface with a corresponding recess 270 provided in the upper surface of the movable roller carrier assembly 244 to receive the distal end of the "T"-shaped draw bolt. The free roller pin 272 securely maintains the guide/alignment bar 252 in contact with the threaded coupling nut 268 to ensure precise vertical movement of the guide/alignment bar and movable roller carrier assembly combination.

Referring to FIG. 14 there is shown an end-on view of a lower corner of the manual crimper 240 shown in FIG. 13. The lower, adjacent corners of the first and second C-shaped plates 246, 248 are spaced approximately ½" apart, with each corner bent 90° and ¼" toward the opposing side of the other plate. A weldment 274 joins the adjacent corners of the first and second C-shaped plates 246, 248 to increase the strength and rigidity of the manual crimper 240. One of the advantages of the embodiment shown in FIG. 13 over the previously described embodiments is that the guide/alignment block and the movable roller carrier assembly could be cast as a single piece as could the first and second C-shaped plates 246 and 248.

The various embodiments of manual crimper of the present invention are used in the following manner in a preferred embodiment. After the facing pairs of rollers are positioned in spaced relation in accordance with the outer diameter of the ferrule to be crimped using either the bushing-like gauge blocks of the embodiment of FIG. 1 or the gauge/stop pins of the other embodiments, the manual crimping apparatus of the present invention is rotationally displaced about the ferrule 4–5 revolutions. The direction of rotation of the crimper is then reversed so that it retraces its original track. After the crimper is returned to its original position, the threaded "T"-shaped draw bolt is tightened ¼ of a turn to reduce the effective swaging diameter by approximately 0.013 of an inch if tighter crimping of the ferrule is desired. This metal spinning process generates a certain amount of heat which further enhances the ductility of the metal ferrule and facilitates crimping of the ferrule without producing cracks or other unwanted deformations therein. The roller dies are offset by approximately 3° relative to the direction of rotation of the manual crimper about the ferrule. With an approximately 3° angle between the axis of rotation of each of the roller dies and the longitudinal axis of the ferrule, six crimping grooves per inch are produced in the ferrule without producing any indentations or sharp edges on the ferrule's outer surface. The flat surface on the outer periphery of the roller dies between the spiral grooves therein smoothes the ferrule as the roller dies traverse the ferrule in a spiral tract. The spiral grooves in each of the roller dies further assist this spiral displacement of the manual crimper relative to the ferrule. The depth of the spiral groove in each of the roller dies is preferably greater than the smallest diameter of the roller die so as to provide the facing outer edges of the roller with an approximately 12° taper. The tapered edges of the roller dies further facilitate gradual crimping of the ferrule and reduces the likelihood of causing structural fatigue or cracking in the ferrule. The threaded shaft of the "T"-shaped draw bolt is preferably ½" in diameter and has 20 threads per inch. The manual crimper of the present invention is preferably capable of accommodating ferrules having an outer diameter ranging from ¼" to ¾".

In accordance with the principles of the present invention, there is illustrated in FIG. 15 a lateral view shown partially in phantom of a manual hose end crimper 310. As in the previously described embodiments, the manual hose end crimper 310 includes a T-shaped draw bolt 312 having a gripping, or handle, portion 314, an enlarged shaft portion 316, and a reduced threaded shaft portion 318 on the distal end thereof. The manual hose end crimper 310 further includes first and second engaging members 326, 328 which are adapted to securely engage and crimp a ferrule 358 disposed therebetween. Each of the first and second engaging members 326, 328 is comprised of a pair of aligned, spaced carrier plates as shown for the first engaging member 326 in the sectional view of FIG. 16 taken along sight line 16—16 in FIG. 15. As shown in FIG. 16, the first engaging member 326 includes first and second spaced carrier plates **330*a* and 330*b*. Adjacent first ends of the first and second engaging members 326 and 328 are coupled by means of the combination of a connecting link 350 and a pair of coupling bolts 354 and 356 inserted through respective aligned holes therein. Each of the coupling bolts 354 and 356 is securely maintained in position within a pair of carrier plates and the connecting link 350 by means of a respective nut 372. The connecting link 350 includes a plurality of spaced apertures 352 along the length thereof. Coupling bolt 354 is inserted through a first aperture (not shown) within the connecting link 350. The spaced apertures 352 within the connecting link 350 permit the spacing between the first and second engaging members 326 and 328 to be either increased or decreased depending upon the outer diameter of the ferrule 358** to be crimped. All of the carrier plates are of the same size and configuration and are thus interchangeable.

Disposed between each pair of spaced carrier plates are a pair of roller dies. Thus, disposed between the spaced carrier plates **330*a* and 330*b* of the first engaging member 326 are first and second roller dies 332 and 334. Similarly, disposed between the spaced carrier plates of the second engaging member 328 are third and fourth roller dies 342 and 344. Each of the aforementioned roller dies is positioned upon and maintained in position by a respective bearing pin inserted through aligned apertures within a pair of spaced carrier plates. Thus, bearing pins 336 and 338 are inserted through aligned apertures in the spaced carrier plates 330*a*, 330*b* of the first engaging member 326 to maintain the first and second roller dies 332, 334, respectively, in position within the first engaging member. Similarly, bearing pins 346 and 348 are inserted through aligned apertures within the carrier plates of the second engaging member 328 as well as through respective apertures in the third and fourth roller dies 342, 344 to maintain the roller dies in position within the second engaging member. Each of the spaced carrier plates of the first and second engaging members 326, 328 is provided with a respective recessed portion 331 and 341** to prevent interference of an engaging member with a ferrule as the crimper is rotationally displaced about the ferrule.

As shown in FIG. 16 for the case of the first engaging member 326, the axes of rotation of the first and second roller dies 332 and 334 are aligned generally parallel and at an angle to the longitudinal axis of the ferrule to be crimped. The axes of rotation of the third and fourth roller dies 342, 344 are also aligned generally in parallel and also form an angle with the longitudinal axis of the ferrule. The relative orientation of the rotational axes of the first and second roller dies 332, 334 relative to the ferrule's longitudinal axis is opposite to that which the rotational axes of the third and fourth roller dies 342, 344 form with the ferrule's longitudinal axis. The angled orientation of each of the four aforementioned roller dies relative to the longitudinal axis of the ferrule 358 disposed therebetween and in contact with these roller dies is described above and is illustrated in FIG. 11. It is this angled orientation which permits the manual hose end crimper 310 to crimp the ferrule 358 along a spiral path extending along the length of the ferrule. Each of the roller dies includes a spiral groove about its circular periphery as shown in FIG. 16 where the spiral grooves **332*a* and 334*a* for the first and second roller dies 332 and 334 are illustrated. The spiral grooves in each of the four aforementioned roller dies further assist in the spiral tracking of the manual crimper 310 as it is rotated about the ferrule 358 positioned therein and engaged thereby. Each of the aforementioned roller pins is securely maintained in position across a pair of carrier plates by means of a respective retaining pin, as shown in FIG. 16 for the case of upper bearing pins 336 and 338 which are respectively maintained in position by retaining pins 368 and 370. A sectional view of the mounting arrangement for the first roller die 332 taken along sight line 19—19 in FIG. 15 is shown in FIG. 19**.

Disposed about and along the length of the reduced threaded portion 318 of the T-shaped draw bolt 312 are a plurality of gauge blocks 320, 322 and 324. Each of the gauge blocks is adapted for positioning between adjacent second end portions of the first and second engaging members 326, 328 for proper spacing of the roller dies in accordance with the outer diameter of the ferrule 358 to be crimped. Thus, where the ferrule 358 has an outer diameter of ½ inch, the ½ inch gauge block 324 is positioned between adjacent ends of the first and second engaging members 326, 328. Each of the aforementioned gauge blocks includes a channel, or aperture, therein through which the threaded portion 318 of the T-shaped draw bolt 312 is inserted. As shown for the case of gauge blocks 320, 322, those gauge blocks which are not being used to establish proper spacing between the first and second engaging members 326, 328 may be positioned along the draw bolt 312 between the first engaging member 326 and the enlarged portion 316 of the T-shaped draw bolt shaft.

While the gauge blocks are disclosed herein as being generally cylindrical having a channel extending therethrough and along the length thereof, they are not limited to this configuration. For example, the gauge blocks may be rectangular in shape having two or three channels extending therethrough and along two or three different axes, each aligned with different lengthwise dimensions of the gauge block. In this case, a single gauge block could be used for both single and double gauge hoses of a given outer diameter by merely inserting the threaded shaft of the draw bolt through a different channel in the gauge block corresponding to the specified length of the gauge block associated with the required outer diameter of the ferrule to be crimped.

The threaded portion 318 of the T-shaped draw bolt 312 is also inserted through respective elongated apertures within a pivotal guide block 360 and a pivotal nut 366 which are shown in greater detail in FIGS. 17 and 18, respectively. The pivotal guide block 360 is disposed between the carrier plates 330*a*, 330*b* of the first engaging member 326. Similarly, the pivotal nut 366 is disposed between respective adjacent ends of the carrier plates of the second engaging member 328. The pivotal guide block 360 includes a smooth channel, or bore, 360*a* extending therethrough through which the threaded portion 318 of draw bolt 312 is inserted. The pivotal nut 366 includes a threaded channel 366*b* extending therethrough through which the threaded portion 318 of the T-shaped draw bolt 312 is inserted. Rotation of the T-shaped draw bolt 312 causes the pivotal nut 366 to be drawn toward the pivotal guide block 360 to permit the four roller dies to securely engage the periphery of a ferrule 358 disposed therebetween.

As shown in FIG. 17, the pivotal nut 366 also includes a pair of lateral inserts 366*a* disposed upon and extending from facing sides thereof. Each of the lateral inserts 366*a* is adapted for insertion in a respective aligned aperture in the carrier plates of the second engaging member 328. With each of its lateral inserts 366*a* positioned within a respective aperture in each of the carrier plates of the second engaging member 328, the pivotal nut 366 is securely maintained in position yet free to rotate between the two carrier plates. The peripheral edge of the pivotal nut 366 is generally circular, with the threaded inner channel 366*b* extending diametrically therethrough.

As shown in FIG. 18, the pivotal guide block 360 disposed between the upper pair of carrier plates 330*a* and 330*b*. The pivotal guide block 360 also includes a pair of lateral inserts 360*a* extending from respective facing lateral surfaces thereof. Each of the lateral inserts 360*a* is adapted for insertion in a respective aperture of one of the aforementioned carrier plates and allows the pivotal guide block 360 to be freely rotated within the first engaging member 326. It can also be seen that the circular periphery of the pivotal guide block 360 extends beyond the edges of the carrier plates of the first engaging member 326 and is engaged by gauge blocks 322 and 324. Similarly, the circular periphery of the pivotal nut 366 extends beyond the edges of the carrier plates of the second engaging member 328 and is in contact with gauge block 324.

The freely pivoting mounting arrangements of each of the guide block 360 within the first engaging member 326 and the pivotal nut 366 within the second engaging member 328 provides a flexible coupling between the T-shaped draw bolt 312 and the generally rectangular frame of the manual hose end crimper 310. A similar pivoting coupling arrangement is provided for between each of the first and second engaging members 326, 328 and the connecting link 350 by means of the respective coupling bolts 354 and 356. The hinge-like coupling arrangement between adjacent members of the manual hose end crimper 310 allows a greater compressive force to be applied to the ferrule 358 via the four roller dies for improved crimping of the ferrule by essentially eliminating internal friction within the manual crimper. The complete flexibility of the generally rectangular frame of the manual hose end crimper 310 not only permits a greater compressive force to be applied to the ferrule 358, but also ensures that the compressive force is applied uniformly about the periphery of the ferrule so as to form a circular crimp. Because of the nonuniformity of the force applied about the ferrule, prior art crimping arrangements have been unable to form a truly circular crimp and have produced irregularities, i.e., high and low spots, about the outer peripheral surface of the ferrule.

Each of the carrier plates includes a notched portion along its length in order to form adjacent angled portions in the carrier plate for proper orientation of the roller dies to provide a spiral track about the ferrule. Thus, as shown in FIG. 16, the two upper carrier plates 330*a* and 330*b* each are provided with respective angled portions 330*c* and 330*d* to ensure that the rotational axes of the roller dies 332 and 334 are not in alignment with, or parallel to, the ferrule's longitudinal axis to allow the roller dies to track a spiral path on the ferrule's outer surface.

Figure 20:
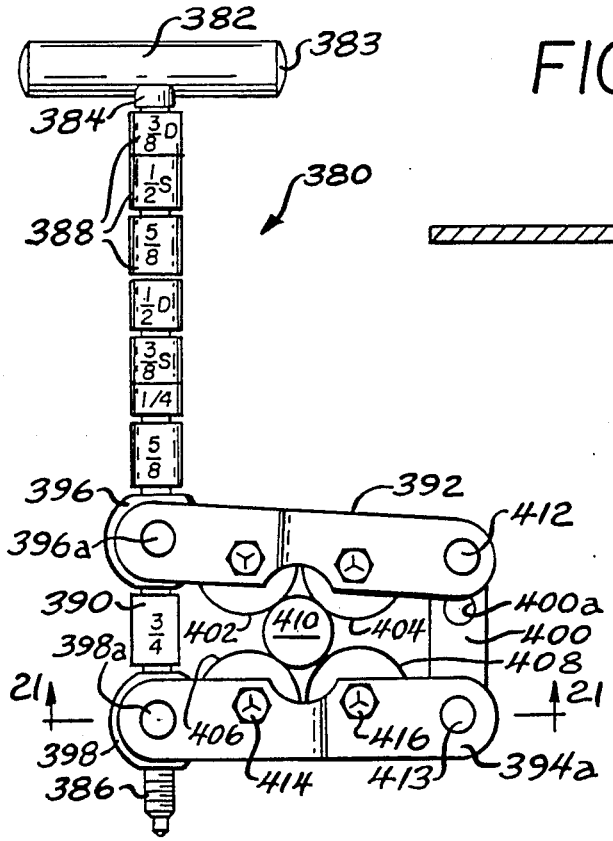
FIG. 20 is a planar view of another embodiment of a manual hose end crimper in accordance with the principles of the present invention.

Referring to FIG. 20, there is shown yet another embodiment of a manual hose end crimper 380 in accordance with the principles of the present invention. This embodiment also includes a T-shaped draw bolt 382 having a handle portion 383, an enlarged portion 384 of an elongated, linear, shaft, and a threaded portion 386 on the distal end of the shaft. Disposed along the length of the threaded portion 386 of the shaft are a plurality of gauge blocks 388. Yet another gauge block 390 is positioned between the upper and lower sets of carrier plates 392, 394 of the manual hose end crimper 380. Each of the aforementioned gauge blocks is selected for positioning about the threaded portion 386 of the draw bolt's shaft and between the upper and lower sets of carrier plates depending upon the outer diameter of the ferrule 410 to be crimped. As shown in FIG. 20, the ¾" gauge block 390 has been selected for positioning upon the threaded shaft 386 and between the upper and lower sets of carrier plates 392, 394 for a ferrule 410 having a ¾" outer diameter.

As in the previously described embodiment, adjacent ends of the upper and lower sets of carrier plates 392, 394 are coupled by means of the combination of a connecting link 400 and upper and lower coupling pins 412, 413. The coupling pins are inserted through respective aligned apertures in the carrier plates and connecting link 400. The connecting link 400 includes a plurality of spaced apertures 400*a* to accommodate a wide range of ferrule outer diameters. First and second rollers 402, 404 are coupled to and positioned between the upper carrier plates 392. Similarly, third and fourth rollers 406, 408 are positioned between and rotationally attached to the lower carrier plates 394*a*, 394*b* by means of roller pins 414 and 416, respectively.

Figure 23:
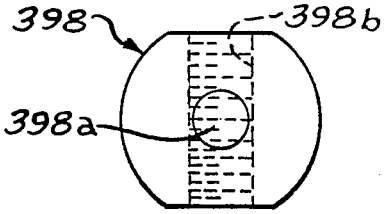
FIG. 23 is a lateral sectional view of a threaded pivot used in the manual hose end crimper shown in FIGS. 20 and 21.
Figure 21:
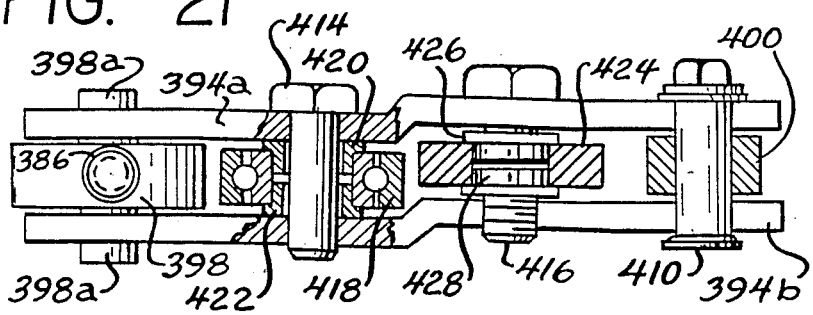
FIG. 21 is a sectional view of the manual hose end crimper shown in FIG. 20 taken along sight line 21—21 therein.
Figure 22:
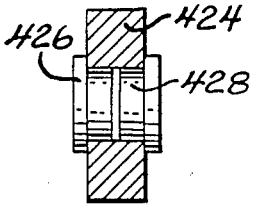
FIG. 22 is a sectional view of a roller die arrangement for use in one embodiment of a manual hose end crimper in accordance with the present invention.

Also as in the previously described embodiment, a pivot guide 396 positioned between the upper carrier plates includes a pair of lateral inserts 396*a* inserted through a respective aperture in each of the upper carrier plates. Similarly, a threaded pivot 398 positioned between the lower carrier plates is provided with a pair of lateral inserts 398*a*, each of which is inserted through a respective aperture in one of the lower carrier plates. While the pivot guide 396 has a smooth internal bore, the threaded pivot 398 is provided with a threaded bore 398*b* as shown in FIG. 23 through which the threaded shaft 386 is inserted. The pivot guide 396 and the threaded pivot 398 are freely rotationally displaceable between their respective pairs of carrier plates to provide the generally rectangular frame of the crimper 380 with the flexibility required for secure, tight fitting engagement of the four rollers with the ferrule 410. The pivot guide 396 and the threaded pivot 398 are each provided with flat upper and lower surfaces to provide secure, stable abutting contact between each of the pivot guide and the threaded pivot and the gauge blocks disposed upon and along the length of the threaded shaft 386. In the embodiment of FIGS. 20 and 21, all four of the carrier plates are of identical size and configuration with the exception that the apertures in carrier plate 394 through which the roller pins 414, 416 are inserted have threads. The threads can be eliminated by an arrangement such as in FIGS. 15 and 16 for mounting the roller dies for using identical plates.

The sectional view of FIG. 21 shows different roller arrangements disposed on each of the roller pins 414 and 416. Disposed about roller pin 414 are a pair of facing first and second inner races 420, 422. Disposed about the combination of the inner races 420, 422 is a roller bearing 418. The combined length of the inner races 420, 422 is less than the distance between the lower carrier plates 394*a* and 394*b* permitting the threaded roller pin 414 to be tightened to its recommended torque specification to allow the inner races 420, 422 to securely engage and hold fixed the inner portion of the roller bearing 418, while the outer periphery of the roller bearing is free to rotate about the roller pin 414.

Disposed about roller pin 416 and positioned between the carrier plates 394*a* and 394*b* are first and second flange bushings 426 and 428. The total length of the flange bushings 426, 428 when arranged in abutting contact is greater than the distance between the carrier plates 394*a*, 394*b*. A roller 424 is disposed about the combination of the first and second flange bushings 426, 428. With the combined length of the first and second flange bushings 426, 428 greater than the distance between the carrier plates 394*a*, 394*b* and with the threaded roller pin 416 tightened to its recommended torque specification, the flange bushings will remain in a fixed orientation while allowing the roller 424 to freely rotate thereabout. The width of the roller 424 is less than the width of the ballbearing 418 to allow for free rotational displacement with the same flanged bushing length.

Figure 24:
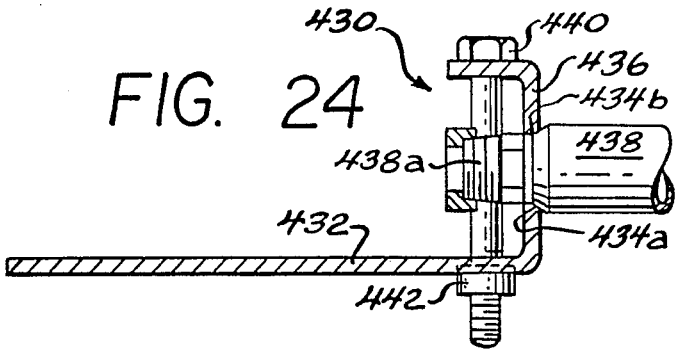
FIG. 24 is a sectional view of a ferrule retainer for use with the manual hose end crimper of the present invention.
Figure 25:
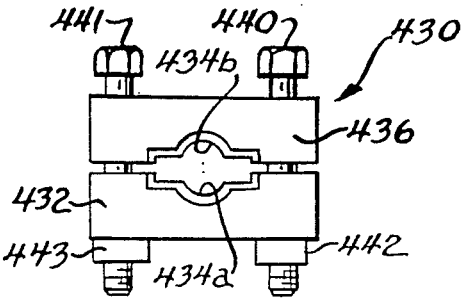
FIG. 25 is an end-on view of the ferrule retainer shown in FIG. 24.

Referring to FIGS. 24 and 25, there are respectively shown lateral sectional and front planar views of a ferrule retainer 430 for engaging and maintaining a ferrule 438 in a fixed position during crimping. The ferrule retainer 430 includes a generally U-shaped upper member 436 and a generally L-shaped lower member 432. Each of the retainer members 432, 436 includes a respective forward notched portion 434*a*, 434*b*, each of which is adapted to receive and securely engage facing portions of the ferrule 438. The recessed portions 434*a*, 434*b* are each provided with a respective sharp edge to more securely engage the ferrule 438. Each of the retainer lower and upper members 432, 436 includes a pair of spaced apertures which are adapted to receive bolts 440 and 441. Disposed on the lower, outer surface of the lower member 432 and about respective apertures therein are insert nuts 442 and 443. Each of the insert nuts 442, 443 is preferably securely attached to the ferrule retainer 430 such as by press fitting. With bolt 440 inserted through respective apertures in the upper and lower members as well as through the insert nut 442 and bolt 441 similarly inserted through aligned apertures as well as through insert nut 443, the lower and upper members 432, 436 may be drawn toward each other so as to securely engage facing lateral portions of a ferrule 438. As shown in FIG. 24, the ferrule 438 may include a threaded, or ridged, end portion 438*a*.

Figure 26:
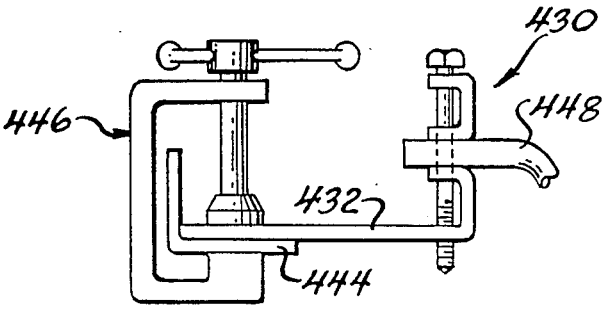
FIG. 26 is a planar view of an arrangement for securely positioning a hose prior to cutting the end of the hose in preparation for securing a ferrule thereon.

Referring to FIG. 26, there is shown an arrangement for securely attaching a ferrule retainer 430 to an angle 444. The angle 444 may be attached to virtually any support structure in the environment for which the manual hose end crimper is intended for use. As shown in the figure, a hose 448 is disposed within and securely engaged by the ferrule retainer 430 in order to permit the end of the hose to be severed prior to attachment of a ferrule. Use of the ferrule retainer 430 ensures that the hose 448 is stably and securely positioned in order to ensure a straight and smooth severance of the hose prior to attachment of the ferrule in accordance with the present invention. The retainer 430 may thus first be used to securely position the hose 448 to prepare an end of the hose for attachment of a ferrule. The retainer 430 is then used to stably position the ferrule and maintain it in position while inserted on the end of the hose during crimping of the ferrule. The lower member 432 is securely attached to the mounting angle 440 by means of a conventional C-clamp 446.

Referring to FIG. 27, there is shown an arrangement for measuring the outer diameter of a ferrule in practicing one embodiment of the present invention. In this approach, the outer diameter of a ferrule to be replaced which is attached to a hose is measured by means of a caliper 456. The ferrule is to be replaced by another ferrule because of a leak, damage to the ferrule, etc. After the outer diameter of the old ferrule is measured by means of the caliper 456 using its micrometer 458, a new ferrule is crimped using a manual crimper in accordance with the present invention until its outer diameter is the same size as that of the old ferrule as measured by the caliper 456. The use of the caliper 456 eliminates the requirement for a gauge block positioned between the pivot guide 396 and threaded pivot 398 for establishing the desired crimping depth on a ferrule.

Referring to FIG. 28, there is shown a side view of yet another embodiment of a manual hose end crimper 460 in accordance with the principles of the present invention. The manual hose end crimper 460 includes a locking pliers, or vise grip, 462 having a threaded shaft 466 at one end thereof. Disposed on the distal end of the threaded shaft 466 is a gripping member, or handle, 464 which, by rotating the gripping member, can be linearly moved along the length of the locking pliers. A gauge block 468 is positioned along the threaded shaft 466 and is engaged by a proximal end of the handle 464. The spacing between a pair of movable members 474, 476 is determined by the width of the gauge block 468 which is positioned between and in contact with the handle 464 and a distal end 471 of the locking pliers 462. When the gauge block 468 is positioned in tight-fitting abutting contact with the handle 464 and the distal end 471 of the locking pliers 462 by rotating the handle and threaded shaft 466, the spacing between the first and second members 474, 476 is fixed.

The manual hose end crimper 460 further includes a pivot arm 470 coupled to the second member 476 by means of linkage 473 for moving the first and second members toward and away from one another. A quick release arm 472 is pivotally coupled to the pivot arm 470 for unlocking the manual hose end crimper 460 and permitting first and second members 474, 476 to be moved apart.

Securely attached to a distal end of the first member 474 is a first roller assembly 475, while attached to a distal end of the second member 476 is a second roller assembly 477. The first roller assembly 475 includes first and second roller dies 478, 480, while the second roller assembly 477 includes third and fourth roller dies 482 and 484. Each of the roller assemblies may be attached to a distal end of a respective one of the first and second members 474, 476 by conventional means such as weldments or mounting bolts 479 as shown in the figure. Alternatively, each of the combination roller assemblies and crimper members may be formed of an integral structure with the aforementioned roller dies rotationally mounted therein. The combination of roller dies is adapted to securely engage and crimp a ferrule 486 disposed therebetween.

As shown in the sectional view of FIG. 29, the third and fourth roller dies 482, 484 have generally parallel rotational axes which are oriented at an angle relative to a longitudinal axis of a ferrule positioned between and engaged by the plurality of roller dies. The first and second roller dies 478, 480 also have their axes of rotation oriented at an angle with respect to the longitudinal axis of the ferrule to be crimped. As in the previously described embodiment, the orientation of the rotational axes of the first and second roller dies 478, 480 relative to the longitudinal axis of a ferrule to be crimped is opposed to the relative orientation of the rotational axes of the third and fourth roller dies 482, 484. This latter, opposed relative orientation of the upper and lower pairs of roller dies is shown in the sectional view of FIG. 30 taken along sight line 30—30 in FIG. 28.

There has thus been shown a manual hose end crimper for tightly and securely crimping a rigid, tube-like ferrule on the end of a hose. The manual crimper includes first and second pairs of roller dies which are movable toward and away from each other so as to accommodate a range of ferrule outer diameters. Each of the roller dies is angled relative to a plane passing through the ferrule and oriented perpendicular to its longitudinal axis so that as the manual crimper is rotated about the ferrule, the roller dies form a spiral track about the ferrule to provide crimping of the ferrule along its length. The length of the crimp may be selected as desired to allow the operator of the crimper to provide a wide, virtually continuous range of crimping contact and mutual engagement between the ferrule and hose end. The several embodiments of the manual crimper allow for adjustments depending upon the outer diameter of the ferrule, which adjustments are easily accomplished by means of a bushing-like spacer element or a gauge/stop pin inserted in one of a plurality of spaced, aligned apertures in the crimper. A spiral groove in the outer periphery of each of the roller dies further promotes displacement of the crimper along the length of the ferrule. A connecting link and a manually operated draw bolt connect respective adjacent ends of a pair of carrier members in which the roller dies are positioned to form a closed frame containing the four roller dies and including a pivoting joint at each of its four corners. The pivoting joints essentially eliminate friction within the crimper's flexible frame as it is reduced in size to allow the roller dies to tightly and uniformly engage the ferrule's outer periphery in forming a strong, smooth, highly uniform circular crimp of the ferrule on a hose. Another embodiment contemplates attachment of the roller dies to the facing, spaced members of a locking pliers. The manual crimper is easily used, inexpensive, portable, and permits the user to select the extent of crimping between the ferrule and hose end.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended t be defined in the following claims when viewed in their proper perspective based on the prior art.

I CLAIM:

1. A manually operated apparatus for crimping a ferrule onto the end of a hose, said apparatus comprising:

a plurality of roller means each having associated therewith respective axes of rotation;

a plurality of carrier means for engaging and supporting respective ones of said roller means in spaced relation;

first pivotal coupling means for pivotally coupling adjacent first ends of each of said plurality of carrier means in a rotationally displaceable manner;

a plurality of second pivotal coupling means each attached to respective adjacent second ends of said plurality of carrier means; and manual control means coupled to each of said plurality of second pivotal coupling means for adjusting the spacing between said plurality of carrier means in positioning said plurality of roller means in tight fitting engagement with a ferrule disposed therebetween so as to exert a compressive force on the ferrule;

wherein the rotational axes of said roller means are oriented at an angle relative to a longitudinal axis of the ferrule such that rotation of the crimping apparatus about the ferrule's longitudinal axis causes said roller means to follow a spiral path along the length of the ferrule in crimping the ferrule to the end of the hose.

2. The apparatus of claim 1 wherein each carrier means includes a pair of spaced plates in generally parallel alignment.

3. The apparatus of claim 2 wherein all of said plates are essentially identical in size and shape.

4. The apparatus of claim 2 wherein one of said roller means is disposed between and coupled to each of said spaced plates in a carrier means.

5. The apparatus of claim 2 wherein each of said roller means includes a plurality of roller dies.

6. The apparatus of claim 5 further comprising a plurality of bearing pins each inserted through and supporting a respective roller die and coupled to adjacent, spaced plates in each carrier means.

7. The apparatus of claim 5 wherein each of said roller dies includes a spiral groove on a curved outer peripheral edge thereof.

8. The apparatus of claim 7 wherein the roller dies disposed between and coupled to the same pair of spaced plates are in general alignment, while the roller dies disposed between and coupled to different pairs of spaced plates are in opposed alignment relative to the longitudinal axis of the ferrule.

9. The apparatus of claim 5 wherein each of said roller dies is oriented at an angle of approximately 3° relative to the longitudinal axis of the ferrule.

10. The apparatus of claim 2 wherein said first pivotal coupling means includes a connecting link pivotally coupled to adjacent first ends of each of said plurality of carrier plates.

11. The apparatus of claim 10 wherein said first pivotal coupling means further includes a plurality of connecting pins pivotally coupling said connecting link to each pair of spaced plates.

12. The apparatus of claim 11 wherein said connecting link includes a plurality of spaced apertures along the length thereof for receiving a connecting pin in permitting the spacing between respective pairs of spaced plates to be fixed in accordance with the size of the ferrule to be crimped.

13. The apparatus of claim 2 wherein said manual control means includes an elongated threaded shaft having a manual gripping portion at one end thereof and a second end coupled to one of said second pivotal coupling means.

14. The apparatus of claim 13 wherein one of said second pivotal coupling means comprises a pivotal guide block having a smooth bore extending therethrough through which a proximal portion of said threaded shaft is inserted.

15. The apparatus of claim 12 wherein said pivotal guide block further includes a pair of opposed lateral inserts each adapted for positioning in a respective aperture in one of said spaced plates.

16. The apparatus of claim 15 wherein said pivotal guide block extends beyond adjacent edges of said pair of spaced plates to permit pivoting displacement of said threaded shaft relative to said pair of spaced plates.

17. The apparatus of claim 16 wherein another one of said second pivotal coupling means comprises a pivotal nut having a threaded bore extending therethrough to which the second, distal end of said threaded shaft is coupled.

18. The apparatus of claim 17 wherein said pivotal nut further includes a pair of opposed lateral inserts each adapted for positioning in a respective aperture in one of said spaced plates.

19. The apparatus of claim 18 wherein said pivotal nut extends beyond adjacent edges of said pair of spaced plates to permit pivoting displacement of said threaded shaft relative to said pair of spaced plates.

20. The apparatus of claim 19 further comprising spacer means disposed between adjacent second ends of said plurality of spaced plates for providing desired spacing between said roller means in accordance with the size of the ferrule.

21. The apparatus of claim 20 wherein said spacer means includes a gauge block disposed between and engaging said pivotal guide block and said pivotal nut.

22. The apparatus of claim 21 wherein said gauge block includes an aperture therein through which said threaded shaft is inserted.

23. The apparatus of claim 21 wherein said spacer means includes a caliper having first and second spaced measuring elements, wherein the spacing between said measuring elements is determined by the size of the ferrule to be crimped.

24. The apparatus of claim 21 further comprising a plurality of gauge blocks selectively insertable between said pivotal guide block and said pivotal nut in accordance with an outer diameter of the ferrule.

25. The apparatus of claim 1 wherein said first and second roller means are oriented at opposed relative angles with a plane perpendicular to a longitudinal axis of the ferrule.

26. A manually operated apparatus for crimping a ferrule onto the end of a hose, said apparatus comprising:

first and second roller means each having associated therewith respective axes of rotation;

first and second carrier means for engaging and supporting said first and second roller means, respectively, in spaced relation;

a first rotating joint means for coupling adjacent first ends of said first and second carrier means in a rotationally displaceable manner;

second and third rotating joint means attached to respective adjacent second ends of said first and second carrier means; and manual control means coupled to said second and third rotating joint means for adjusting the spacing between said first and second carrier means in positioning said first and second roller means in tight fitting engagement with a ferrule disposed therebetween so as to exert a compressive force on the ferrule;

wherein the rotational axes of said roller means are oriented at an angle relative to a longitudinal axis of the ferrule such that rotation of the crimping apparatus about the ferrule's longitudinal axis causes said roller means to follow a spiral path along the length of the ferrule in crimping the ferrule to the end of the hose.

27. A manually operated apparatus for crimping a ferrule onto the end of a hose, said apparatus comprising:

a locking pliers including first and second spaced members, movable gripping means coupled to said spaced members for moving said members toward and away from one another, and locking means for establishing said first and second members in fixed, spaced relation from each other; and first and second roller means respectively attached to said first and second members and adapted to securely engage a lateral surface of a ferrule disposed therebetween, wherein each of said roller means has an associated axis of rotation and wherein the rotational axes of said first and second roller means are oriented at an angle relative to a longitudinal axis of the ferrule such that rotation of the crimping axis about the ferrule's longitudinal axis causes said roller means to follow a spiral path along the length of the ferrule in crimping the ferrule to the end of a hose.

28. The apparatus of claim 27 wherein each of said roller means includes a plurality of roller dies.

29. The apparatus of claim 28 further comprising a plurality of bearing pins inserted through and supporting a respective roller die and coupled to a respective one of said spaced members.

30. The apparatus of claim 29 wherein each of said roller dies includes a spiral groove on a curved outer peripheral edge thereof.

31. The apparatus of claim 30 wherein the roller dies coupled to said first spaced member are in general alignment while the roller dies coupled to said second spaced member are in opposed alignment relative to the longitudinal axis of the ferrule.

32. The apparatus of claim 28 wherein each of said roller dies is oriented at an angle of approximately 3° relative to the longitudinal axis of the ferrule.

33. The apparatus of claim 27 further comprising spacer means for establishing the spacing between said first and second roller means in accordance with the size of the ferrule to be crimped.

34. The apparatus of claim 33 wherein said spacer means includes a gauge block disposed on said locking pliers and movable therealong by means of a threaded member.

35. The apparatus of claim 34 further comprising a plurality of gauge blocks, wherein each of said gauge blocks is selected for positioning on said threaded member in accordance with an outer diameter of the ferrule.

36. The apparatus of claim 33 wherein said spacer means includes a caliper having first and second spaced measuring elements, wherein the spacing between said measuring elements is determined by the size of the ferrule to be crimped.

37. The apparatus of claim 27 wherein said first and second roller means are oriented at opposed angles relative to a plane perpendicular to a longitudinal axis of the ferrule.

38. The apparatus of claim 27 further comprising engaging means for engaging and securely maintaining the ferrule in a fixed orientation and position during crimping.

39. The apparatus of claim 38 wherein said engaging means includes first and second engaging members movably coupled together and having respective concave edges arranged in facing relation and adapted to engage opposed portions of the ferrule.

* * * * *